US009594337B2

(12) United States Patent
Shimba et al.

(10) Patent No.: US 9,594,337 B2
(45) Date of Patent: Mar. 14, 2017

(54) IMAGE FORMING APPARATUS FOR DETECTING MISREGISTRATION AMOUNT AND DENSITY

(71) Applicant: CANON KABUSHIKI KAISHA, Tokyo (JP)

(72) Inventors: Takeshi Shimba, Kawasaki (JP); Ken Nakagawa, Yokohama (JP); Shinri Watanabe, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 11 days.

(21) Appl. No.: 13/868,555

(22) Filed: Apr. 23, 2013

(65) Prior Publication Data

US 2013/0302050 A1 Nov. 14, 2013

(30) Foreign Application Priority Data

May 11, 2012 (JP) ..... 2012-109929

(51) Int. Cl.
*G03G 15/01* (2006.01)
*G03G 15/00* (2006.01)

(52) U.S. Cl.
CPC ..... *G03G 15/55* (2013.01); *G03G 15/01* (2013.01); *G03G 15/0189* (2013.01);
(Continued)

(58) Field of Classification Search
CPC ..... G03G 15/5041; G03G 2215/00059; G03G 15/0824; G03G 15/55; G03G 15/0189; G03G 15/5058
(Continued)

(56) References Cited

U.S. PATENT DOCUMENTS 6,246,844 B1 * 6/2001 Shiba ..... 399/49
6,381,435 B2 4/2002 Shinohara et al.
(Continued)

FOREIGN PATENT DOCUMENTS

CN 102375367 A 3/2012
JP 1-167769 A 7/1989
(Continued)

OTHER PUBLICATIONS

Communication dated Dec. 9, 2013, forwarding a European Search Report dated Nov. 29, 2013, in European Application No. 13165035.0-1560.
(Continued)

*Primary Examiner* — Walter L Lindsay, Jr.
*Assistant Examiner* — Philip Marcus T Fadul
(74) *Attorney, Agent, or Firm* — Fitzpatrick, Cella, Harper & Scinto

(57) ABSTRACT

An image forming apparatus includes a control unit configured to detect a misregistration amount and densities of the toner images by detecting first and second detection patterns. The first detection pattern includes black and color portions, and the control unit is further configured to set a light-emitting amount of a detection unit, a threshold, or a sensitivity of a detection unit so that a received light amount of diffuse reflection light from the black portion is less than the threshold and a received light amount of diffuse reflection light from the color portion exceeds the threshold, and to set the light-emitting amount or the sensitivity so that the received light amount of the diffuse reflection light from the color portion is less than an upper limit of the detection unit.

25 Claims, 18 Drawing Sheets

(52) U.S. Cl.
CPC ..... *G03G 15/5058* (2013.01); *G03G 2215/00042* (2013.01); *G03G 2215/0161* (2013.01); *G03G 2215/0164* (2013.01)

(58) Field of Classification Search
USPC ..... 399/49, 58, 59
See application file for complete search history.

(56) References Cited

U.S. PATENT DOCUMENTS

| | | | | |
|---|---|---|---|---|
| 6,847,791 | B2 | 1/2005 | Kitagawa et al. | |
| 7,020,404 | B2 | 3/2006 | Fukuda et al. | |
| 7,313,352 | B2 | 12/2007 | Shinohara et al. | |
| 7,315,378 | B2 | 1/2008 | Phelan et al. | |
| 7,894,101 | B2 | 2/2011 | Ichinose et al. | |
| 2001/0004425 | A1 | 6/2001 | Shinohara et al. | |
| 2002/0113968 | A1* | 8/2002 | Parisi et al. | B41J 29/393 356/399 |
| 2004/0052554 | A1* | 3/2004 | Harada et al. | G03G 15/0194 399/301 |
| 2004/0208661 | A1* | 10/2004 | Kitagawa | G03G 15/5058 399/49 |
| 2009/0207430 | A1 | 8/2009 | Hirose et al. | |
| 2010/0232817 | A1 | 9/2010 | Miyadera et al. | |
| 2011/0280605 | A1 | 11/2011 | Kishi | |
| 2012/0045234 | A1* | 2/2012 | Suzuki et al. | 399/49 |
| 2012/0224191 | A1* | 9/2012 | Abe | 358/1.5 |
| 2012/0288289 | A1* | 11/2012 | Kinoshita | 399/39 |
| 2013/0156472 | A1 | 6/2013 | Watanabe | |

FOREIGN PATENT DOCUMENTS

| | | | |
|---|---|---|---|
| JP | 11-143171 | A | 5/1999 |
| JP | 2001-166553 | A | 6/2001 |
| JP | 2003-186278 | A | 7/2003 |
| JP | 2004-093972 | A | 3/2004 |
| JP | 2004-110018 | A | 4/2004 |
| JP | 2004-188665 | A | 7/2004 |
| JP | 2004-252172 | A | 9/2004 |
| JP | 2004-252321 | A | 9/2004 |
| JP | 2004-361406 | A | 12/2004 |
| JP | 2005-173253 | A | 6/2005 |
| JP | 2005-266246 | A | 9/2005 |
| JP | 2005-337749 | A | 12/2005 |
| JP | 2006-208266 | A | 8/2006 |
| JP | 2006-251652 | A | 9/2006 |
| JP | 2006-251686 | A | 9/2006 |
| JP | 2006-267644 | A | 10/2006 |
| JP | 2006-284892 | A | 10/2006 |
| JP | 2007-10744 | A | 1/2007 |
| JP | 2008-185914 | A | 8/2008 |
| JP | 2008-261864 | A | 10/2008 |
| JP | 2009-134037 | A | 6/2009 |
| JP | 2009-150690 | A | 7/2009 |
| JP | 2010-117735 | A | 5/2010 |
| JP | 2010-271735 | A | 12/2010 |
| JP | 2011-059333 | A | 3/2011 |
| JP | 2012-042674 | A | 3/2012 |
| JP | 2012-42884 | A | 3/2012 |

OTHER PUBLICATIONS

Office Action in Korean Patent Application No. 10-2013-0052963, dated Aug. 13, 2015.
Office Action in Chinese Patent Application No. 201310170639.X, dated May 5, 2015.
Office Action in Korean Patent Application No. 10-2013-0052963, dated Apr. 25, 2016.
Office Action in Japanese Patent Application No. 2012-109929, dated Nov. 14, 2016.
Sekiguchi et al., U.S. Appl. No. 13/855,880, filed Apr. 3, 2013.
Nakagawa et al., U.S. Appl. No. 13/859,872, filed Apr. 10, 2013.
Shimba et al., U.S. Appl. No. 13/868,557, filed Apr. 23, 2013.
Nakagawa et al., U.S. Appl. No. 13/915,926, filed Jun. 12, 2013.

* cited by examiner

IMAGE FORMING APPARATUS FOR DETECTING MISREGISTRATION AMOUNT AND DENSITY

BACKGROUND OF THE INVENTION

Field of the Invention

The present invention mainly relates to an image forming apparatus such as a copying machine or printer of an electrophotography system or electrostatic storage system and, more particularly, to a control of a density and registration in an image forming apparatus.

Description of the Related Art

An image forming apparatus including a plurality of photosensitive members often causes relative misregistration between colors due to mechanical attachment errors of the photosensitive members, errors of optical path lengths of laser beams of respective colors, changes of optical path lengths, and the like. Also, image densities of respective colors vary depending on usage environments and various conditions such as the number of copies to be printed, thus causing a color balance variation.

For this reason, Japanese Patent Laid-Open Nos. 01-167769 and 11-143171 disclose an arrangement in which detection patterns as toner images used to detect misregistration amounts and densities are respectively formed on an intermediate transfer belt so as to correct the misregistration and densities. In these documents, misregistration and density detection patterns are detected by a single detection unit, thereby avoiding increases of a size and cost of the apparatus.

Japanese Patent Laid-Open No. 2001-166553 discloses an arrangement in which when misregistration and density corrections have to be successively executed, both misregistration and density detection patterns are formed on an intermediate transfer belt and are detected, thereby shortening a time required for correction control processing.

A sensor used to detect a density is controlled to be able to detect a density even when the intermediate transfer belt and light-emitting element deteriorate. By contrast, since misregistration detection uses a toner density in a detection pattern or a density difference between the detection pattern and the surface of the intermediate transfer belt, for example, when the density difference is small, misregistration often fails to be detected. When misregistration fails to be detected, process conditions (for example, a laser light amount, charging bias, developing bias, and the like) are changed based on the density detection result, and misregistration detection is restarted, resulting in a long correction control time.

SUMMARY OF THE INVENTION

The present invention provides an image forming apparatus which can detect both misregistration and density detection patterns using the same settings.

According to an aspect of the present invention, an image forming apparatus includes: an image forming unit configured to form toner images of respective colors on an image carrier; a detection unit configured to irradiate a surface of the image carrier or the toner images formed on the image carrier with light, and to receive reflection light; and a control unit configured to control to detect a relative misregistration amount of the toner images of the respective colors formed on the image carrier by determining, using a threshold, a received light amount of the detection unit when the detection unit detects a first detection pattern as a toner image formed on the image carrier, and to detect densities of the toner images of the respective colors formed on the image carrier by detecting, by the detection unit, a second detection pattern as a toner image formed on the image carrier. The first detection pattern includes a black portion as a portion of a black toner image, and a color portion as another color portion, and the control unit is further configured to form, when the misregistration amount and the densities are successively detected, both the first detection pattern and the second detection pattern on the image carrier, to set a light-emitting amount of the detection unit, the threshold, or a sensitivity of the detection unit so that a received light amount of diffuse reflection light from the black portion received by the detection unit is less than the threshold and a received light amount of diffuse reflection light from the color portion received by the detection unit exceeds the threshold, and to set the light-emitting amount of the detection unit or the sensitivity of the detection unit so that the received light amount of the diffuse reflection light from the color portion is less than an upper limit value of the received light amount of the diffuse reflection light configured to be received by the detection unit.

Further features of the present invention will become apparent from the following description of exemplary embodiments with reference to the attached drawings.

DESCRIPTION OF THE EMBODIMENTS

First Embodiment

Figure 1:
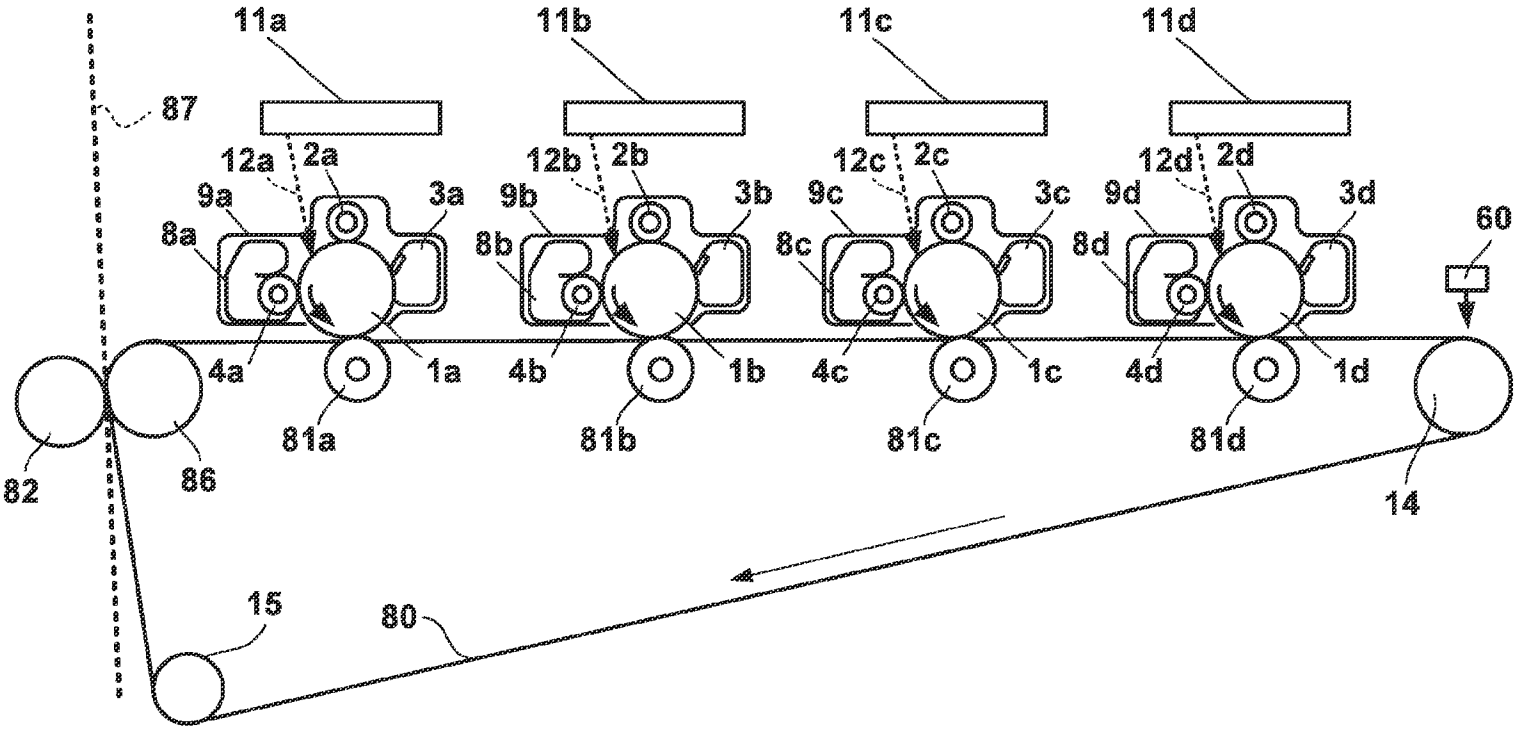
FIG. 1 is a view showing the arrangement of an image forming unit of an image forming apparatus according to one embodiment.

FIG. 1 is a schematic view showing the arrangement of an image forming unit of an image forming apparatus according to this embodiment. Note that components which are not required for understanding of an embodiment are omitted from the following figures for the sake of simplicity. Note that in FIG. 1, components whose reference numerals end with alphabet "a" are used to form a yellow (Y) toner image on an intermediate transfer belt 80. Likewise, components whose reference numerals end with alphabets "b", "c", and "d" are used to respectively form magenta (M), cyan (C), and black (K) toner images on the intermediate transfer belt 80. Note that the operations of the components used to form toner images of respective colors on the intermediate transfer belt 80 are the same except for colors of toners as developing agents, and the components used to form the yellow toner image on the intermediate transfer belt 80 will be representatively described below.

A charging roller 2*a* is in contact with a photosensitive member 1*a* as an image carrier and uniformly charges the surface of that photosensitive member. An exposure unit 11*a* forms an electrostatic latent image on the photosensitive member 1*a* by irradiating the surface of the photosensitive member 1*a* with a laser beam 12*a*, which is modulated based on an image signal. A developing unit 8*a* has yellow toner, and forms a toner image by developing the electrostatic latent image on the photosensitive member 1*a* with the toner using a developing roller 4*a* which is in contact with the photosensitive member 1*a*. A primary transfer roller 81*a* transfers the toner image formed on the photosensitive member 1*a* onto the intermediate transfer belt 80 as an image carrier. A cleaning unit 3*a* cleans the toner which is not transferred onto the intermediate transfer belt 80 and remains on the photosensitive member 1*a*. Note that the photosensitive member 1*a*, charging roller 2*a*, cleaning unit 3*a*, and developing unit 8*a* form an integrated process cartridge 9*a* which is detachable from the image forming apparatus.

The intermediate transfer belt 80 is supported by three rollers, that is, a secondary transfer opposing roller 86, driving roller 14, and tension roller 15, so as to maintain an appropriate tension. By driving the driving roller 14, the intermediate transfer belt 80 moves at roughly equal velocities in a forward direction with respect to the photosensitive members 1*a* to 1*d*. By transferring toner images of respective colors on the intermediate transfer belt 80 to overlap each other, a color image is formed. The toner image transferred on the intermediate transfer belt 80 is transferred onto a printing material conveyed along a conveyance path 87 by a secondary transfer roller 82. The toner image transferred onto the printing material is fixed by a fixing unit (not shown).

Figure 2:
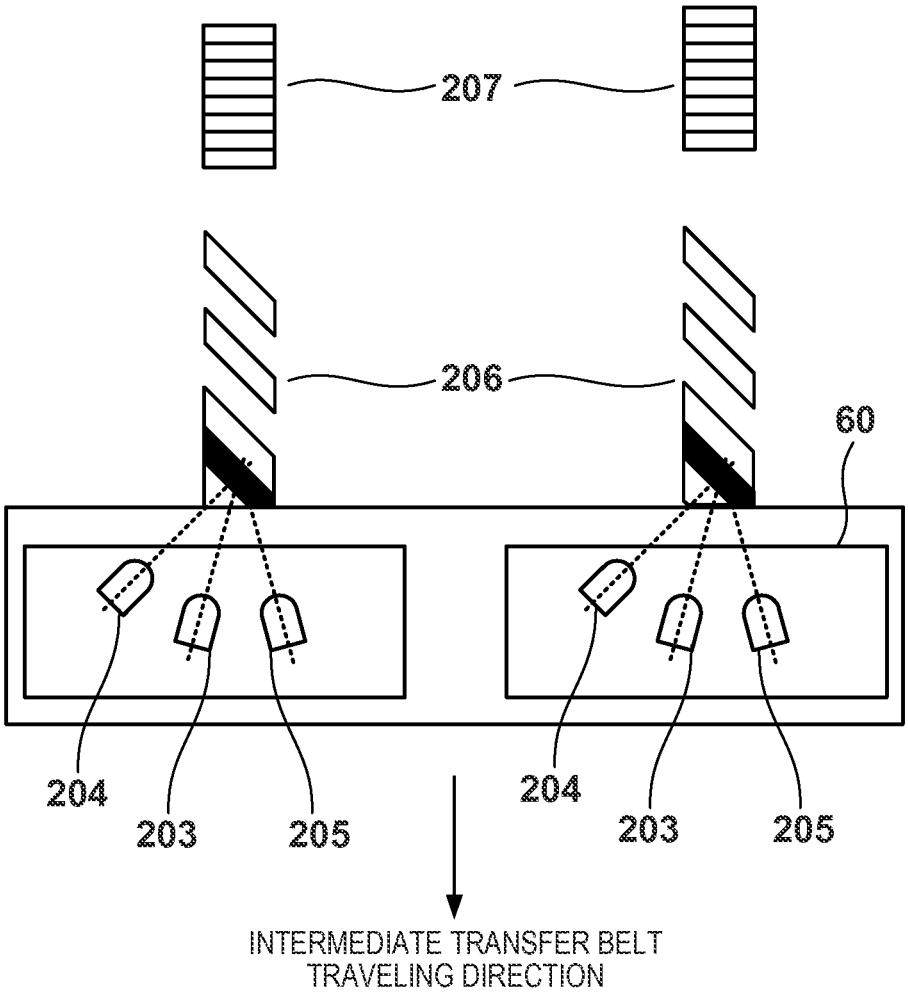
FIG. 2 is a view showing the arrangement of a sensor unit according to one embodiment.

The image forming unit includes a sensor unit 60 used to implement misregistration/density detection/correction at a position opposing the intermediate transfer belt 80, as shown in FIG. 1. FIG. 2 shows the arrangement of the sensor unit 60 according to this embodiment. The sensor unit 60 includes a light-emitting element 203 which emits light toward the intermediate transfer belt 80, and light-receiving elements 204 and 205 used to receive light which is emitted by the light-emitting element 203 and is reflected by the surface of the intermediate transfer belt 80 or detection patterns formed on that surface. Note that the light-receiving element 204 receives light which is diffusely reflected by the surface of the intermediate transfer belt 80 or the detection patterns, and the light-receiving element 205 receives light which is specularly reflected by the surface or the detection patterns. The light-receiving elements 204 and 205 respectively output detection voltages according to their received light amounts. Note that in order to detect detection patterns formed on respective sides of the intermediate transfer belt 80, sets each including the light-emitting element 203 and light-receiving elements 204 and 205 are also arranged on the respective sides of the intermediate transfer belt 80. Note that FIG. 2 also illustrate a state in which misregistration detection patterns 206 and density detection patterns 207 are formed on the intermediate transfer belt 80. Note that in this embodiment, detection patterns are formed on the intermediate transfer belt 80, and are detected by the sensor unit 60. Alternatively, the detection patterns may be formed on an arbitrary image carrier including a printing material.

Figure 3:
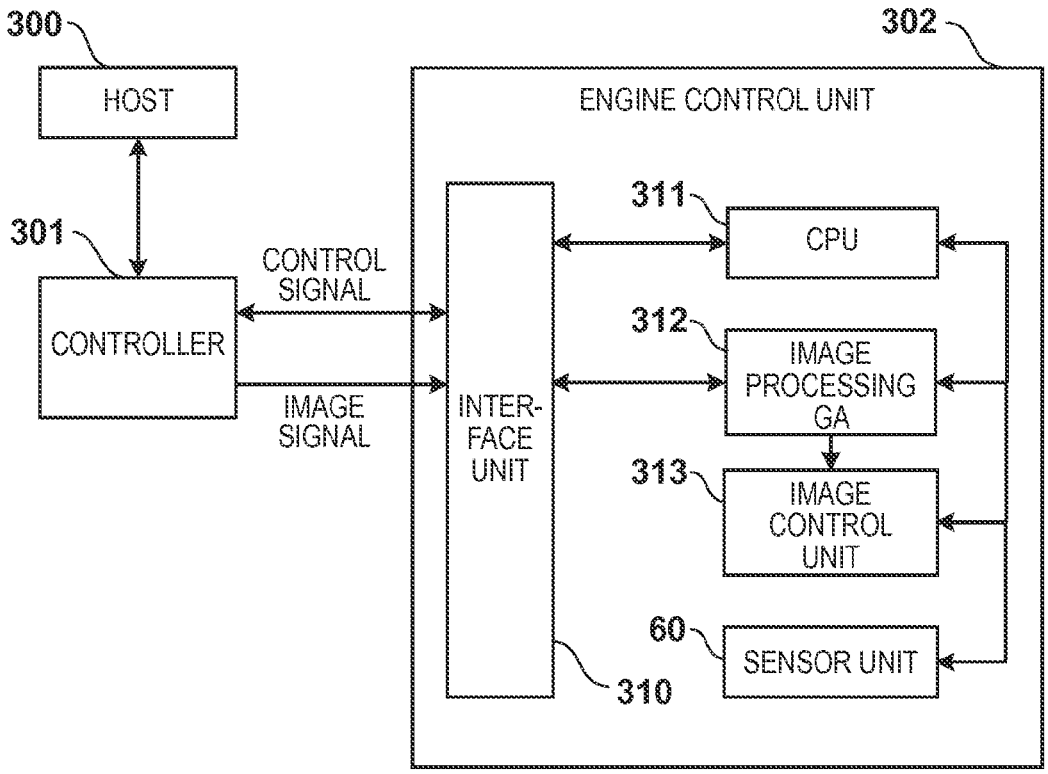
FIG. 3 is a block diagram showing the arrangement of the image forming apparatus according to one embodiment.

FIG. 3 is a block diagram for explaining the system arrangement of the image forming apparatus. A controller 301 can communicate with a host computer 300 and engine control unit 302. Upon execution of misregistration/density correction control, the controller 301 outputs a correction control start command to the engine control unit 302. Upon reception of the correction control start command via an interface unit 310, a CPU 311 instructs an image control unit 313 to start correction control. Upon reception of the correction control start instruction, the image control unit 313 controls the image forming unit to prepare for formation of detection patterns. After completion of preparation, the CPU 311 requests the controller 301 to transmit image signals corresponding to the detection patterns. The controller 301 outputs the image signals to the engine control unit 302 in response to the request from the CPU 311.

Upon reception of the image signals from the controller 301, an image processing GA 312 transmits image forming data to the image control unit 313, which controls the image forming unit so as to form detection patterns on the intermediate transfer belt 80 based on the image forming data. After that, the CPU 311 acquires voltage values according to the densities of the detection patterns from the sensor unit 60. The CPU 311 calculates density correction amounts of the formed detection patterns of respective colors and misregistration correction amounts of the detection patterns of the respective colors in the main scanning direction and sub-scanning direction, based on the detection voltage values from the sensor unit 60. The CPU 311 notifies the controller 301 of the calculated misregistration correction amounts and density correction amounts via the interface unit 310.

Figure 4A:
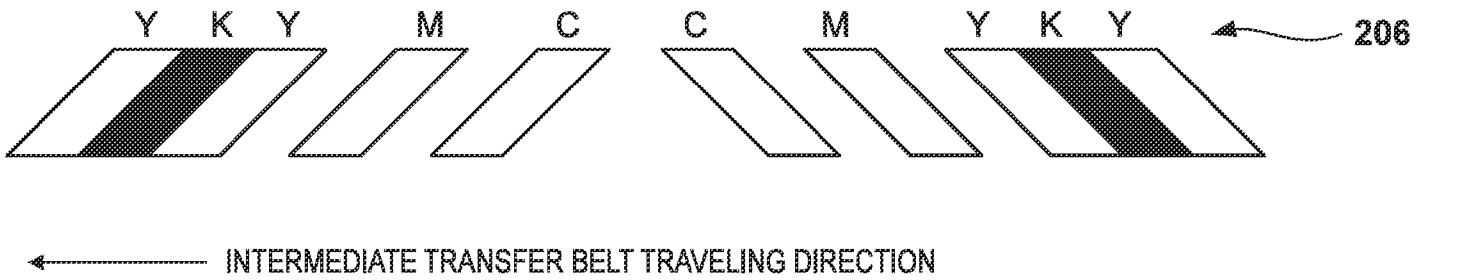
FIGS. 4A and 4B are views showing detection patterns according to one embodiment.
Figure 4B:
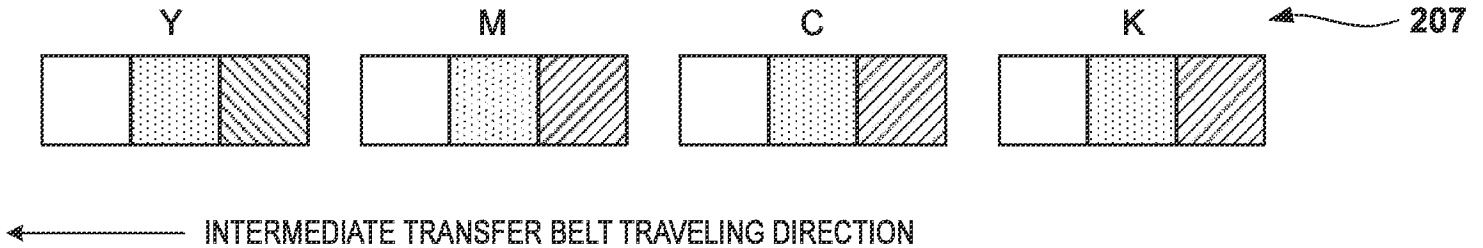

FIGS. 4A and 4B show the detection patterns used in this embodiment. FIG. 4A shows the misregistration detection pattern 206 (first detection pattern), and FIG. 4B shows the density detection pattern 207 (second detection pattern). Note that the detection patterns 206 and 207 are formed on the respective sides of the intermediate transfer belt 80, as shown in FIG. 2. Also, in this embodiment, since misregistration and density corrections are successively executed, the density detection pattern 207 is formed on the side behind the misregistration detection pattern 206 in the traveling direction of the intermediate transfer belt 80. Note that the detection pattern 206 and subsequent detection pattern 207 can be repetitively formed on, for example, the circumference of the intermediate transfer belt 80.

As shown in FIG. 4A, the misregistration detection pattern 206 includes a detection pattern obtained by forming a black (K) toner image on a yellow (Y) toner image and detection patterns of magenta (M) and cyan (C) toner images alone. Note that the black toner image may be formed on the magenta or cyan toner image in place of the yellow toner image. The density detection pattern 207 includes toner images of a plurality of densities for respective colors. Note that in the following description, of the misregistration detection pattern 206, yellow, magenta, and cyan portions will be referred to as color portions, and a black portion will be referred to as a black portion.

Figure 5A:
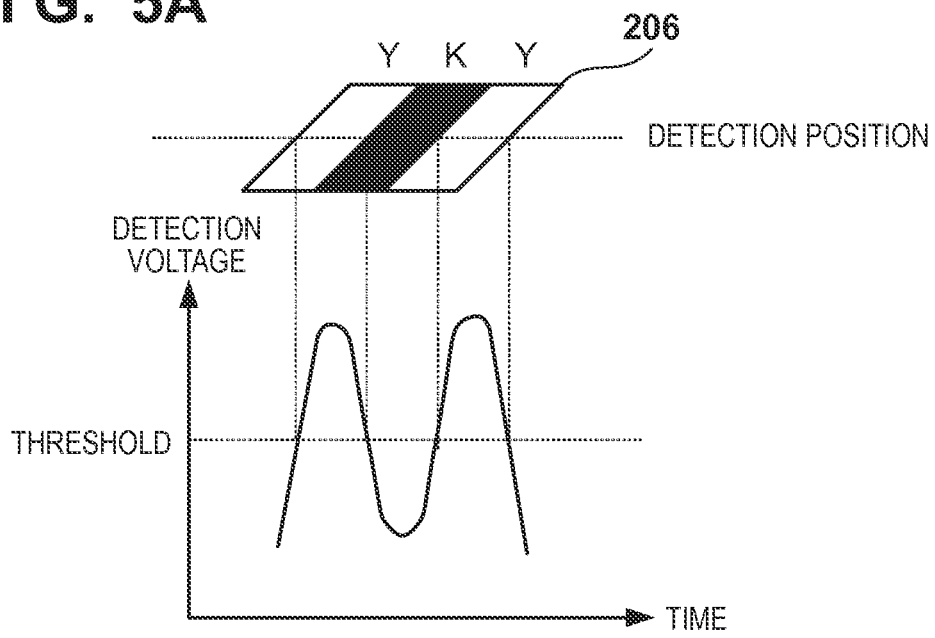
FIGS. 5A and 5B show the relationships between detection patterns and detection voltages according to one embodiment.

The CPU 311 determines a detection voltage corresponding to a received diffuse reflection light amount, which is output from the light-receiving element 204 of the sensor unit 60, using a threshold to determine a boundary of each color portion, thereby detecting a relative misregistration amount between colors. In this case, since diffuse reflection light from the surface of the intermediate transfer belt 80 is small, when a detection region of the sensor unit 60 does not include any detection pattern, a low detection voltage is output from the light-receiving element 204. In this state, when a yellow portion in FIG. 5A moves into the detection region of the sensor unit 60, since the received light amount of diffuse reflection light increases in the color portion, the detection voltage of the light-receiving element 204 rises. When the detection voltage of the light-receiving element 204 exceeds the threshold, the CPU 311 determines that a boundary between the surface of the intermediate transfer belt 80 and color portion is passed. After that, when a black portion in FIG. 5A moves into the detection region of the sensor unit 60, since diffuse reflection light from the black portion is small, the detection voltage of the light-receiving element 204 decreases. When the detection voltage falls below the threshold, the CPU 311 determines that a boundary between the color portion and black portion is passed. After that, when the detection voltage of the light-receiving element 204 rises, and exceeds the threshold, the CPU 311 determines that a boundary between the black portion and color portion is passed. Furthermore, when the detection voltage of the light-receiving element 204 decreases again, and falls below the threshold, the CPU 311 determines that a boundary between the color portion and the surface of the intermediate transfer belt 80 is passed. Note that in case of magenta and cyan detection patterns, when the detection voltage of the light-receiving element 204 rises and exceeds the threshold, and when the detection voltage then decreases and falls below the threshold, the CPU 311 determines that boundaries between the detection pattern 206 and intermediate transfer belt 80 are passed.

Therefore, the detection voltage of the light-receiving element 204 at the time of detection of the color portion of the detection pattern 206 has to be higher than the threshold. Also, the detection voltage of the light-receiving element 204 at the time of detection of the black portion has to be lower than the threshold.

Figure 5B:
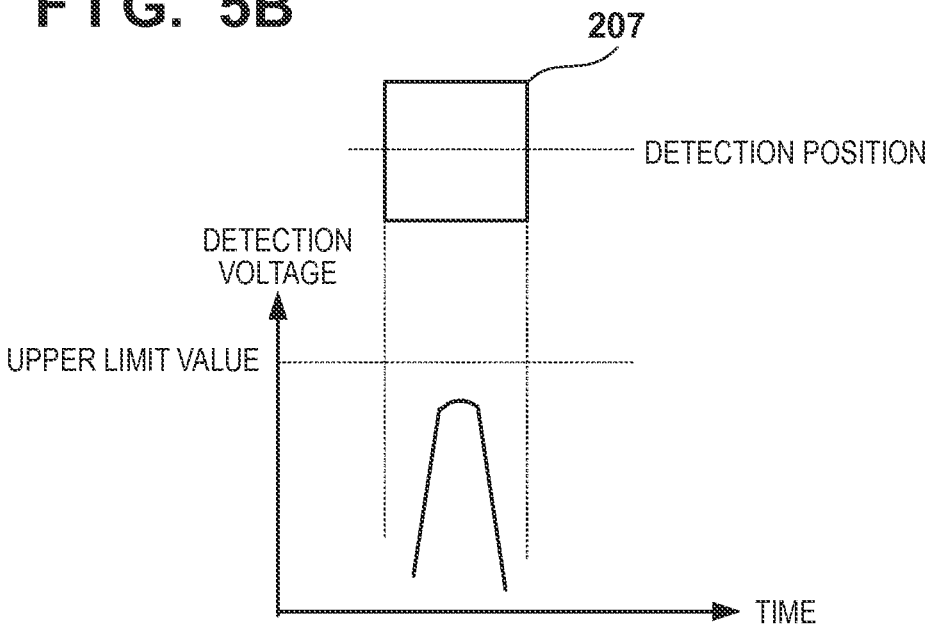

Also, at the time of density control, the CPU 311 determines densities using specular reflection light received by the light-receiving element 205 of the sensor unit 60 and diffuse reflection light received by the light-receiving element 204. In this case, when the output from the light-receiving element 204 or an A/D converter upon converting the output into digital data suffers saturation, density detection fails. Therefore, an upper limit value of the detection voltage free from any saturation, that is, an upper limit value that can be received by the light-receiving element 204 has to be decided, so that the detection voltage of the light-receiving element 204 is less than the upper limit value, as shown in FIG. 5B.

For example, when the detection voltage of the light-receiving element 204 does not exceed the threshold due to the low density of the color portion and the small light amount of the light-emitting element 203, the CPU 311 can no longer detect a position of the detection pattern 206. Also, when the detection voltage of the light-receiving element 204 at the detection timing of the black portion does not fall below the threshold due to the low density of the black portion and the large light amount of the light-emitting element 203, the CPU 311 can no longer detect the position of the detection pattern 206. Furthermore, when the detection voltage of the light-receiving element 204 at the detection timing of the detection pattern 207 saturates due to the large light amount of the light-emitting element 203, the density can no longer be detected.

The misregistration detection pattern 206 is normally formed to have a maximum density. However, since the surface state of the toner image of the detection pattern 206 is not uniform, the diffuse reflection light varies. Hence, in consideration of such variation, a minimum voltage value of the color portion to be detected by the light-receiving element 204 and a maximum voltage value of the black portion to be detected are calculated first by starting the correction control. In this case, if the calculated voltage values satisfy the following conditions, a position detection failure can be prevented.

$$\text{Minimum voltage value at detection timing of color portion} > \text{threshold} \quad (1)$$

$$\text{Maximum voltage value at detection timing of black portion} < \text{threshold} \quad (2)$$

Likewise, a maximum voltage value of the density detection pattern 207 to be detected by the light-receiving element 204 is obtained by measurement. In this case, if the obtained voltage value satisfies the following condition, a density detection failure can be prevented.

$$\text{Maximum voltage value at detection timing of detection pattern 207} < \text{upper limit value of received light amount of light-receiving element 204} \quad (3)$$

Note that at the time of density detection, maximum diffuse reflection light is obtained when a toner image of a maximum density is formed, and since the misregistration detection pattern 206 is formed to have the maximum density, the condition given by inequality (3) can be replaced by:

$$\text{Maximum voltage value at detection timing of color portion} < \text{upper limit value of received light amount of light-receiving element 204} \quad (4)$$

Figure 6:
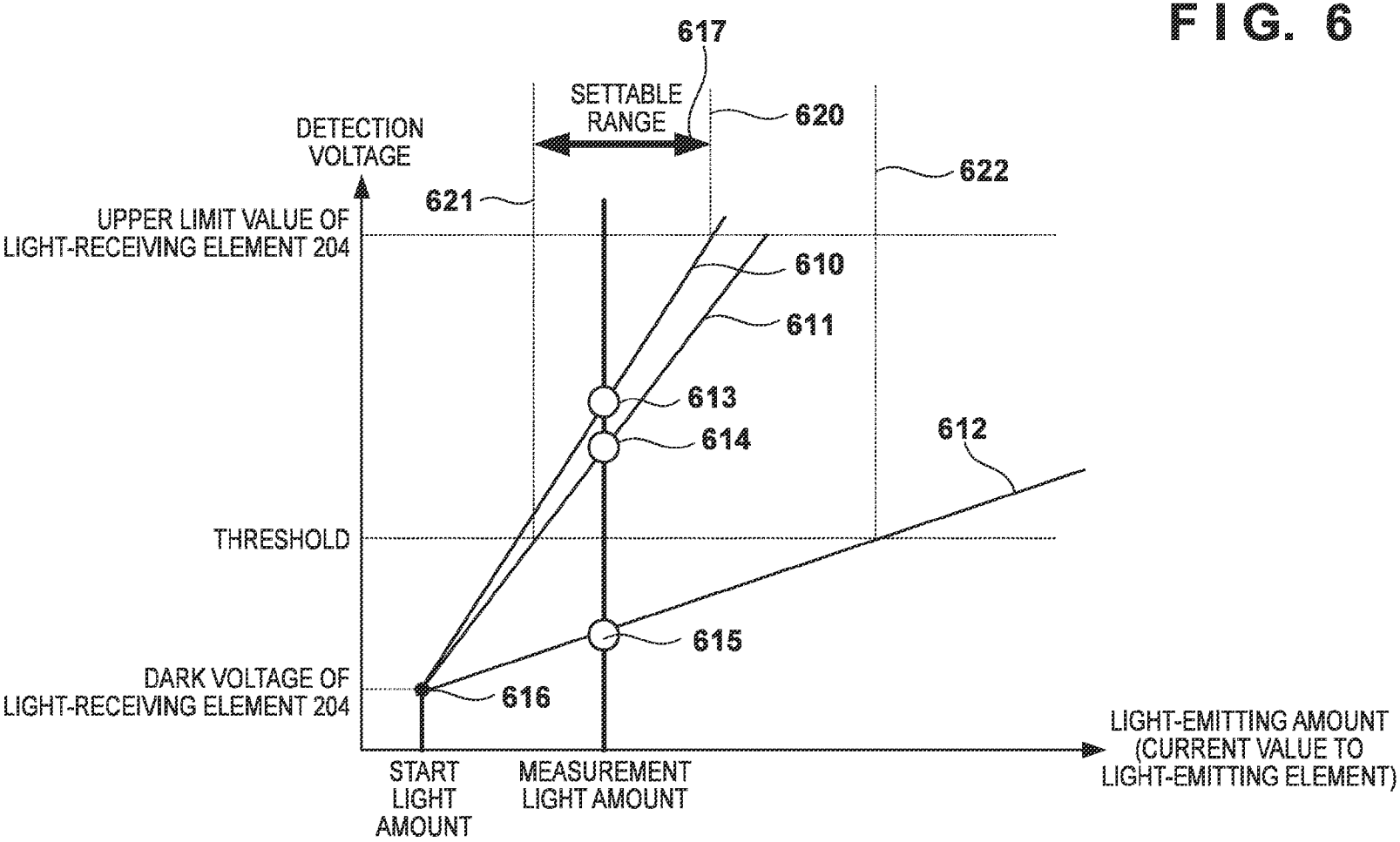
FIG. 6 is an explanatory graph of decision of a light amount of a light-emitting element according to one embodiment.

A method of changing the light amount of the light-emitting element 203 to meet inequalities (1), (2), and (4) will be described below with reference to FIG. 6. In FIG. 6, a start light amount corresponds to a point where light emission starts first when a current to the light-emitting element 203 is increased. Assume that in this embodiment, the start light amount and a dark voltage of the light-receiving element 204 at a point 616 are saved in advance in a storage unit (not shown). The point 616 indicates that a detection voltage of the start light amount is a dark voltage, and is used as a reference value of emission light amount control to be described below. Assume that in this embodiment, the threshold is determined in advance, and the sensitivity of the sensor unit 60 assumes a predetermined value. A point 614 indicates a minimum voltage value of the color portion detected by the sensor unit 60 when the light-emitting element 203 is set to have an arbitrary measurement light amount. A line 611 which connects the points 614 and 616 represents the relationship between the light amount of the light-emitting element 203 and the minimum voltage value of the sensor unit 60 at the detection timing of the color portion. From inequality (1), the light-emitting element 203 can use a light amount when the line 611 exceeds the threshold, but it cannot use a light amount when the line 611 becomes not more than the threshold. Therefore, a light amount at a position denoted by reference numeral 621 is a minimum light amount of the light-emitting element 203.

Likewise, a point 615 indicates a maximum voltage value of the black portion detected by the sensor unit 60 when the light-emitting element 203 is set to have an arbitrary measurement light amount. A line 612 which connects the points 616 and 615 represents the relationship between the light amount of the light-emitting element 203 and the maximum voltage value of the sensor unit 60 at the detection timing of the black portion. From inequality (2), the light-emitting element 203 can use a light amount when the line 612 is less than the threshold, but it cannot use a light amount when the line 612 becomes not less than the threshold. Therefore, the light amount of the light-emitting element 203 has to be smaller than at least that denoted by reference numeral 622. A light amount at the position denoted by reference numeral 622 will be referred to as a maximum light amount candidate hereinafter.

Furthermore, a point 613 indicates a maximum voltage value of the color portion detected by the sensor unit 60 when the light-emitting element 203 is set to have an arbitrary measurement light amount. A line 610 which connects the points 616 and 613 represents the relationship between the light amount of the light-emitting element 203 and the maximum voltage value of the sensor unit 60 at the detection timing of the color portion. From inequality (4), the light-emitting element 203 can use a light amount when the line 610 is less than an upper limit value, but it cannot use a light amount when the line 610 becomes not less than the upper limit value. Therefore, the light amount of the light-emitting element 203 has to be smaller than at least that denoted by reference numeral 620. A light amount at the position denoted by reference numeral 620 will be referred to as a maximum light amount candidate hereinafter.

Therefore, in case of the state shown in FIG. 6, a lower limit of a light amount which can be set in the light-emitting element 203 is a minimum light amount (second light-emitting amount) denoted by reference numeral 621. On the other hand, an upper limit of a light amount which can be set in the light-emitting element 203 is smaller one of a maximum light amount candidate (first light-emitting amount) denoted by reference numeral 620 and a maximum light amount candidate (third light-emitting amount) denoted by reference numeral 622. In the example of FIG. 6, the light amount at the position denoted by reference numeral 620 is set as the maximum light amount. Therefore, a light amount range which can be set in the light-emitting element 203 is that denoted by reference numeral 617. In this embodiment, a light amount between the minimum and maximum light amounts (for example, a middle light amount) is set as that of the light-emitting element 203. However, an arbitrary light amount can be set as long as it falls within a range between the minimum and maximum light amounts.

Figure 7:
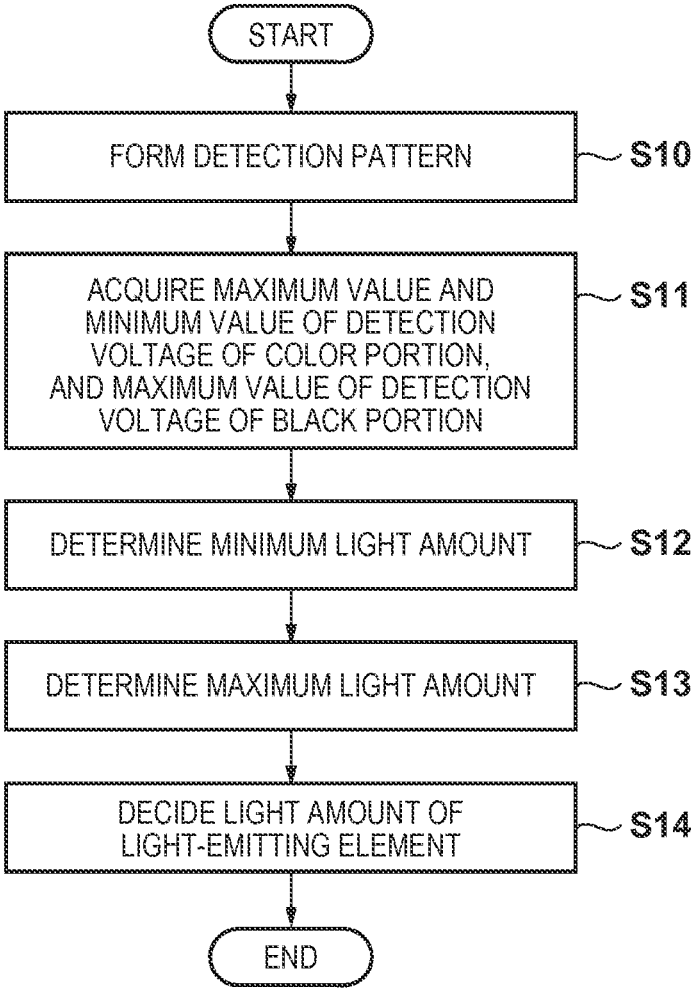
FIG. 7 is a flowchart of light amount decision control of a light-emitting element according to one embodiment.

FIG. 7 is a flowchart of light amount setting processing of the light-emitting element 203 executed by the engine control unit 302 in the first embodiment. When the misregistration/density detection control is started, the CPU 311 controls the image forming unit to form respective detection patterns in step S10. In step S11, the CPU 311 acquires minimum and maximum values of the detection voltage of the color portion of the detection pattern 206 and a maximum value of the detection voltage of the black portion. In step S12, the CPU 311 determines a minimum light amount based on the minimum value of the detection voltage of the color portion. In step S13, the CPU 311 determines a maximum light amount based on the maximum value of the detection voltage of the color portion and that of the detection voltage of the black portion, as described above. Finally, the CPU 311 decides a light amount between the minimum and maximum light amounts as that to be set in the light-emitting element 203 in step S14. For example, a middle light amount between the minimum and maximum light amounts can be set in the light-emitting element 203. Note that after the aforementioned processing, the CPU 311 executes misregistration/density correction using the formed detection patterns.

With the aforementioned arrangement, the light-emitting amount of the light-emitting element 203 required to successively execute misregistration detection and density detection can be decided and set.

Second Embodiment

In the first embodiment, the light amount of the light-receiving element 203 is set based on the received light amount of the light-receiving element 204 for diffuse reflection light used in both misregistration and density detections. In this embodiment, a misregistration amount is decided based on the received light amount of specular reflection light received by the light-receiving element 205. Therefore, the light amount of the light-emitting element 203 is set using the received light amount of the light-receiving element 205 used in both control operations. Note that differences from the first embodiment will be mainly explained below, and a description of the same parts as in the first embodiment (for example, the arrangement of the image forming apparatus) will not be repeated.

Figure 8:
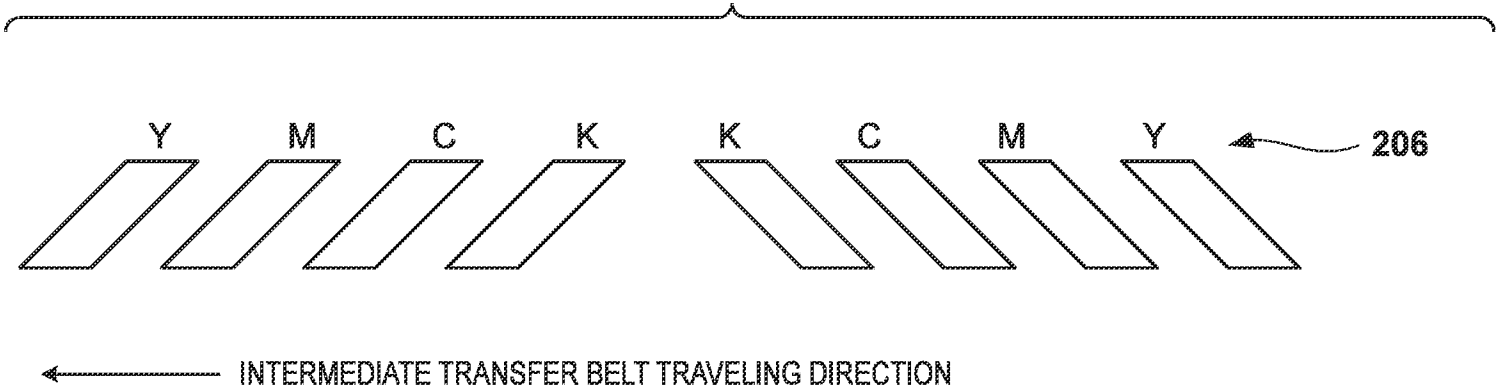
FIG. 8 is a view showing a detection pattern according to one embodiment.

In this embodiment, a detection pattern 206 shown in FIG. 8 is used in place of the detection pattern 206 shown in FIG. 4A for the purpose of misregistration detection. The detection pattern shown in FIG. 8 is different from the detection pattern 206 shown in FIG. 4A in that a black toner image is not formed on a yellow toner image, but these toner images are independently formed.

Figure 9A:
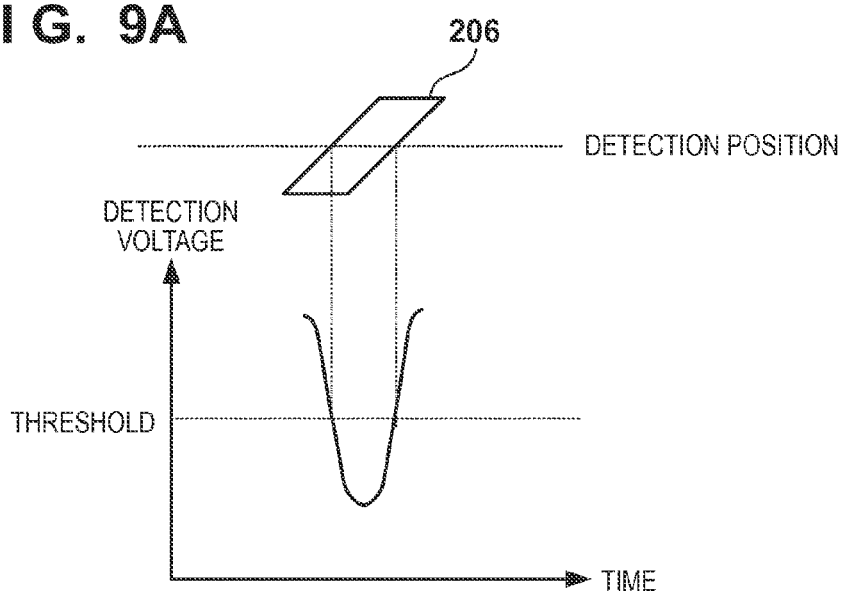
FIGS. 9A and 9B show the relationships between detection patterns and detection voltages according to one embodiment.

Specular reflection light by the detection pattern 206 is smaller than that by the surface of the intermediate transfer belt 80, and becomes smaller with increasing density of the detection pattern 206. Therefore, as shown in FIG. 9A, a detection voltage of the light-receiving element 205 at the time of detection of the detection pattern 206 is lower than that at the time of detection of the surface of the intermediate transfer belt 80. Hence, when the detection voltage of the light-receiving element 205 is less than a threshold, the CPU 311 determines that the detection pattern 206 is detected. That is, the detection voltage of the light-receiving element 205 at the time of detection of the surface of the intermediate transfer belt 80 has to be higher than the threshold, and that of the light-receiving element at the time of detection of the detection pattern 206 has to be lower than the threshold.

Figure 9B:
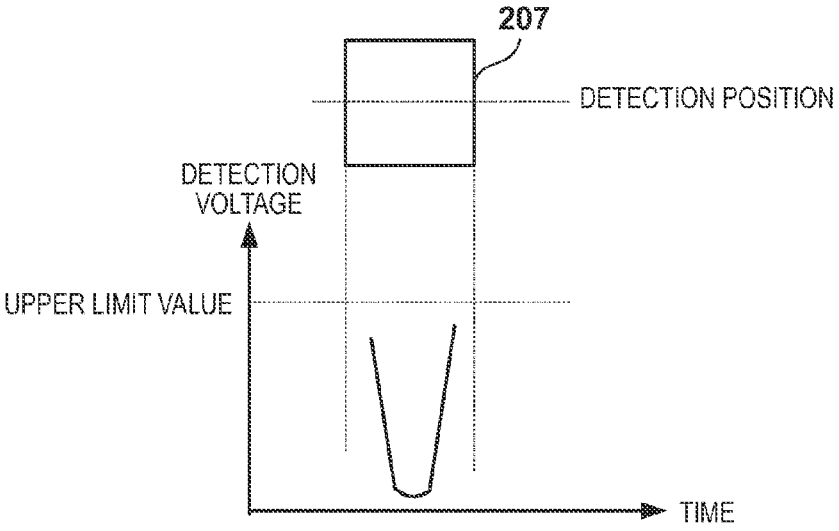

Also, as shown in FIG. 9B, for the purpose of density detection, the detection voltage of the light-receiving element 205 at the time of detection of the density detection pattern 207 has to be lower than an upper limit value of the detection voltage of the light-receiving element 205, that is, an upper limit value that can be received by the light-receiving element 205.

Specular reflection light from the intermediate transfer belt and detection patterns varies since the surface states of the intermediate transfer belt 80 and detection patterns are not uniform. Therefore, in consideration of such variation, a minimum voltage value of the intermediate transfer belt 80 and a maximum voltage value of the misregistration detection pattern 206, which are to be detected by the light-receiving element 205, are obtained by measurements. In this case, if the obtained voltage values satisfy the following conditions, a position detection failure can be prevented.

Minimum voltage value at detection timing of intermediate transfer belt surface>threshold (5)

Maximum voltage value at detection timing of detection pattern 206<threshold (6)

Likewise, a maximum voltage value of the density detection pattern 207 to be detected by the light-receiving element 205 is obtained by measurement. In this case, if the obtained voltage value satisfies the following condition, a density detection failure can be prevented.

Maximum voltage value at detection timing of detection pattern 207<upper limit value of received light amount of light-receiving element 205 (7)

Note that specular reflection light is maximized at the detection timing of the surface of the intermediate transfer belt 80 and, hence, the condition defined by inequality (7) can be replaced by:

Maximum voltage value at detection timing of intermediate transfer belt surface<upper limit value of received light amount of light-receiving element 205 (8)

Figure 10:
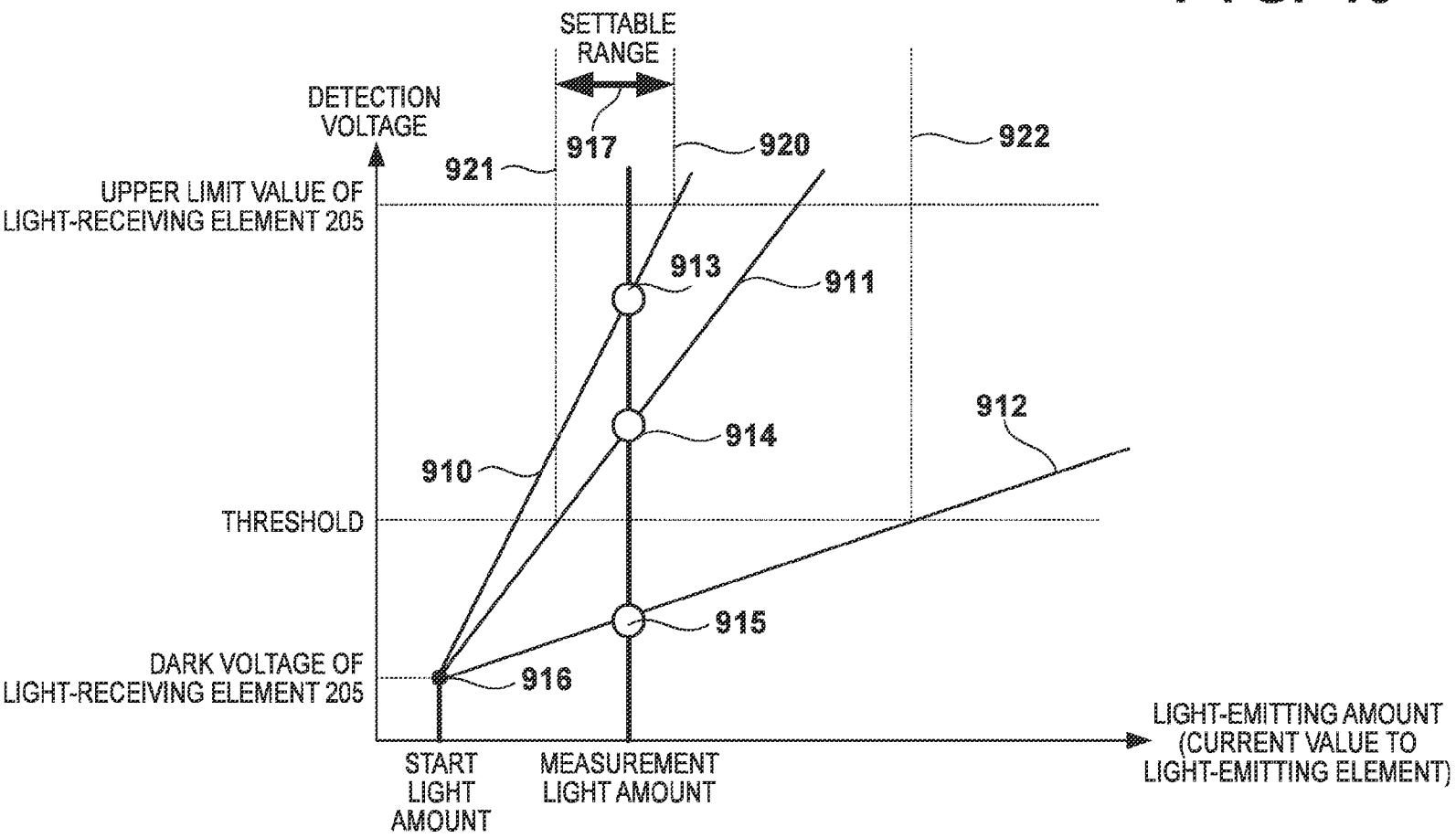
FIG. 10 is an explanatory graph of decision of a light amount of a light-emitting element according to one embodiment.

A method of changing the light amount of the light-emitting element 203 so as to meet inequalities (5), (6), and (8) will be described below with reference to FIG. 10. A point 916 indicates a start light amount, which has already been described. Assume in this embodiment as well, the start light amount and dark voltage of the point 916 are saved in advance in a storage unit (not shown). Also, a point 914 indicates a minimum voltage value obtained when the light-emitting element 203 is set to have an arbitrary measurement light amount, and the light-receiving element 205 detects the surface of the intermediate transfer belt 80. A line 911 which connects the points 914 and 916 represents the relationship between the light amount of the light-emitting element 203 and the minimum voltage value at the detection timing of the surface of the intermediate transfer belt 80. From inequality (5), the light-emitting element 203 can use a light amount when the line 911 exceeds a threshold, but it cannot use a light amount when the line 911 is not more than the threshold. Hence, a light amount at a position denoted by reference numeral 921 is a minimum light amount of the light-emitting element 203.

Likewise, a point 915 indicates a maximum voltage value at the detection timing of the detection pattern 206 by the light-receiving element 205 when the light-emitting element 203 is set to have an arbitrary measurement light amount. A line 912 which connects the points 916 and 915 represents the relationship between the light amount of the light-emitting element 203 and the maximum voltage value at the time of detection of the detection pattern 206. From inequality (6), the light-emitting element 203 can use a light amount when the line 912 is less than the threshold, but it cannot use a light amount when the line 912 is not less than the threshold. Therefore, the light amount of the light-emitting element 203 has to be smaller than at least a light amount denoted by reference numeral 922. The light amount at the position denoted by reference numeral 922 will be referred to as a maximum light amount candidate hereinafter.

Furthermore, a point 913 indicates a maximum voltage value at the detection timing of the surface of the intermediate transfer belt 80 by the light-receiving element 205 when the light-emitting element 203 is set to have an arbitrary measurement light amount. A line 910 which connects the points 916 and 913 represents the relationship between the light amount of the light-emitting element 203 and the maximum voltage value at the detection timing of the surface of the intermediate transfer belt 80. From inequality (8), the light-emitting element 203 can use a light amount when the line 913 is less than an upper limit value, but it cannot use a light amount when the line 913 is not less than the upper limit value. Therefore, the light amount of the light-emitting element 203 has to be set to be smaller than at least a light amount denoted by reference numeral 920. The light amount at the position denoted by reference numeral 920 will be referred to as a maximum light amount candidate hereinafter.

The CPU 311 sets smaller one of the maximum light amount candidates as a maximum light amount as in the first embodiment. Also, a light amount range which can be set in the light-emitting element 203 is a range which is larger than the minimum light amount and is less than the maximum light amount, as denoted by reference numeral 917. Note that in this embodiment, a middle light amount between the minimum and maximum light amounts is set as the light amount of the light-emitting element 203. However, an arbitrary light amount can be set as long as it falls within a range between the minimum and maximum light amounts.

Figure 11:
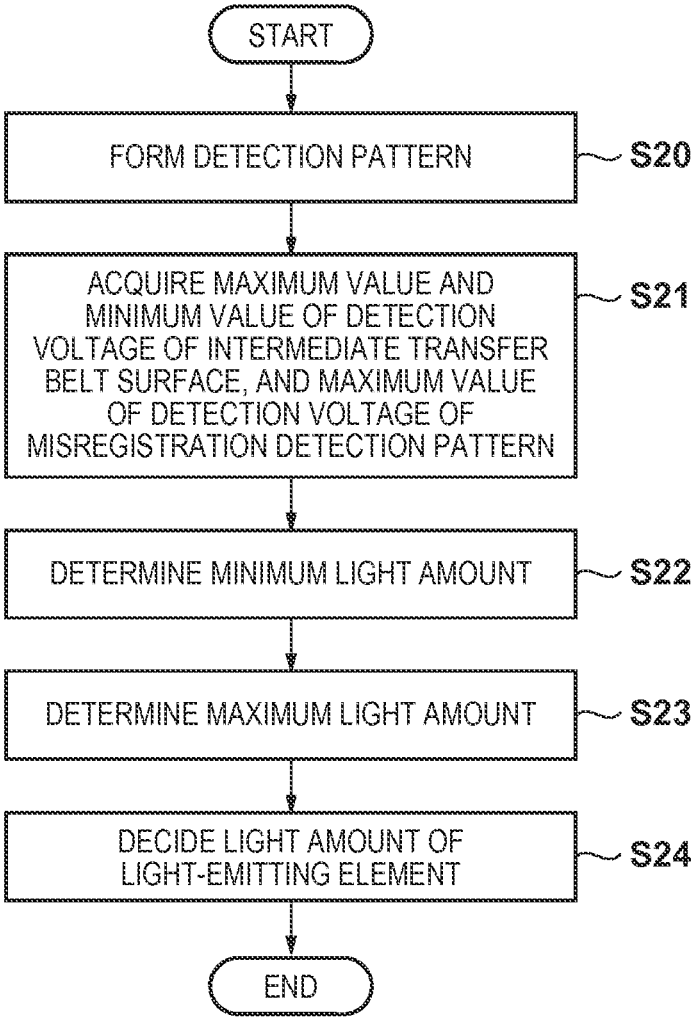
FIG. 11 is a flowchart of light amount decision control of a light-emitting element according to one embodiment.

FIG. 11 is a flowchart of the light amount setting processing of the light-emitting element 203 executed by the engine control unit 302 in the second embodiment. When the misregistration/density detection control is started, the CPU 311 controls the image forming unit to form respective detection patterns in step S20. In step S21, the CPU 311 acquires minimum and maximum values of a detection voltage at the detection timing of the surface of the intermediate transfer belt 80 by the light-receiving element 205, and a maximum value of a detection voltage at the detection timing of the misregistration detection pattern 206. In step S22, the CPU 311 determines a minimum light amount based on the minimum value of the detection voltage of the light-receiving element 205 at the detection timing of the surface of the intermediate transfer belt 80. In step S23, the CPU 311 determines a maximum light amount based on the maximum value of the detection voltage of the light-receiving element 205 at the detection timing of the surface of the intermediate transfer belt 80 and that of the detection voltage of the light-receiving element 205 at the detection timing of the detection pattern 206. Finally, the CPU 311 decides a light amount between the minimum and maximum light amounts as that to be set in the light-emitting element 203 in step S24. For example, a middle light amount between the minimum and maximum light amounts can be set in the light-emitting element 203.

With the aforementioned arrangement, the light-emitting amount of the light-emitting element 203 required to successively execute misregistration detection and density detection can be decided and set.

Third Embodiment

The first and second embodiments set the light amount of the light-emitting element 203 based on the received light amount of the light-receiving element 204 or 205. However, when the light amount of the light-emitting element 203 is changed using either one light-receiving element, the received light amount of the other light-receiving element is also changed. For example, the received light amount of the other light-receiving element may fall outside a received light range. In this embodiment, in the arrangement of the first embodiment, the light amount of the light-emitting element 203 is set in consideration of a detection voltage of the light-receiving element 205, that is, the received light amount of specular reflection light. Note that differences from the first embodiment will be mainly described below, and a description of the same parts as in the first embodiment (for example, the arrangement of the image forming apparatus) will not be repeated.

This embodiment sets the light amount of the light-emitting element 203 by adopting inequality (8) in the second embodiment as a condition in addition to those described by inequalities (1), (2), and (4) in the first embodiment.

A method of changing the light amount of the light-emitting element 203 so as to meet inequalities (1), (2), (4), and (8) will be described below with reference to FIG. 12. Note that in FIG. 12, the relationship associated with inequality (8) is added to the graph shown in FIG. 6, and a description of the contents described using FIG. 6 will not be repeated.

Figure 12:
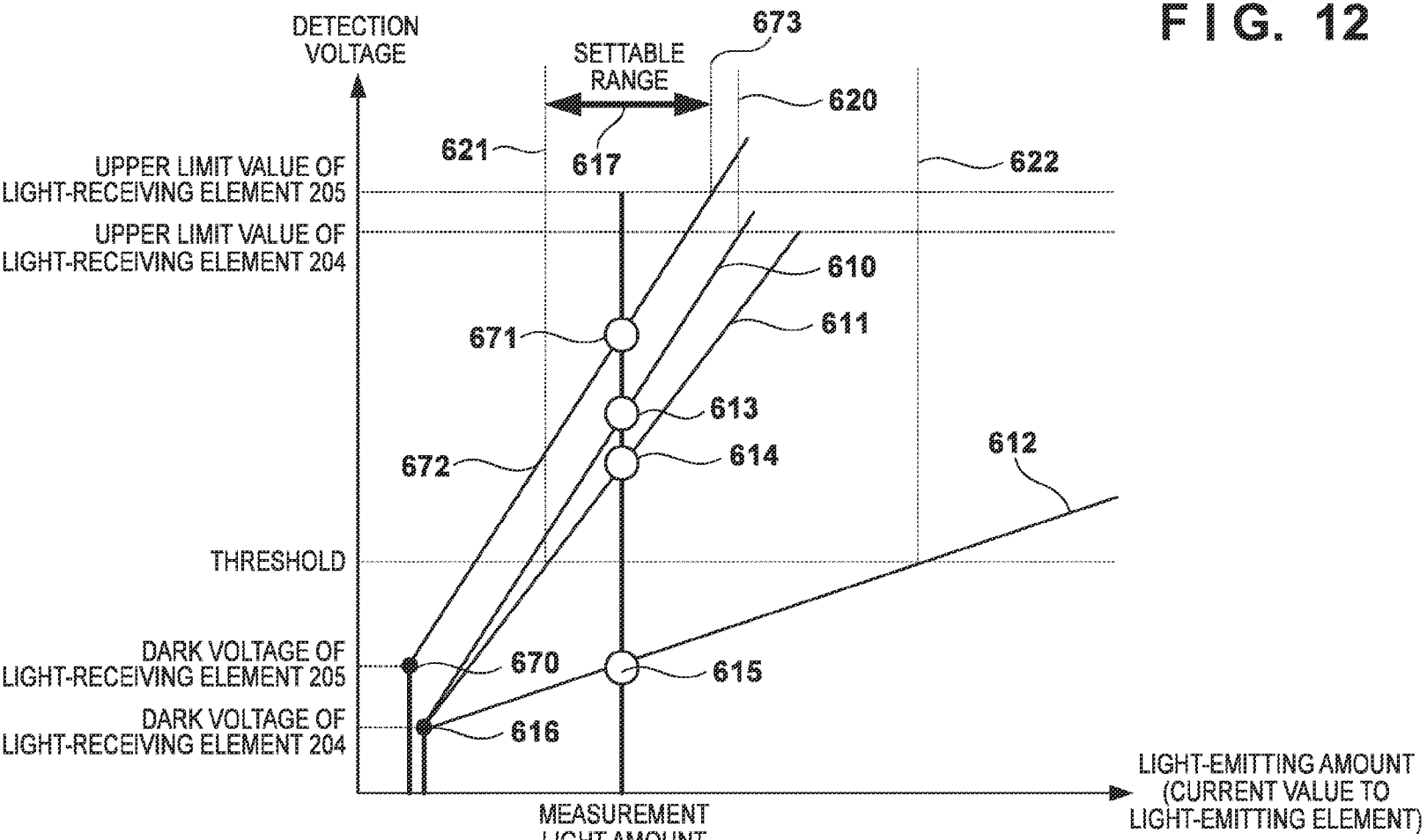
FIG. 12 is an explanatory graph of decision of a light amount of a light-emitting element according to one embodiment.

Referring to FIG. 12, reference numeral 670 denotes a relationship between a start light amount and dark voltage of the light-receiving element 205. That is, the point 670 corresponds to the point 916 in FIG. 10. A point 671 indicates a maximum voltage value of the light-receiving element 205 at the detection timing of the surface of the intermediate transfer belt 80 when an arbitrary measurement light amount is set. A line 672 which connects the points 671 and 670 represents the relationship between the light amount of the light-emitting element 203 and the maximum voltage value of the intermediate transfer belt 80 detected by the light-receiving element 205. From inequality (8), the light-emitting element 203 can use a light amount when the line 672 is less than an upper limit value of the light-receiving element 205, but it cannot use a light amount when the line 672 is not less than the upper limit value of the light-receiving element 205. Hence, a light amount denoted by reference numeral 673 also becomes a maximum light amount candidate of the light-emitting element 203 together with those denoted by reference numerals 622 and 620.

Therefore, in case of the state shown in FIG. 12, a lower limit of the light amount which can be set in the light-emitting element 203 is a minimum light amount denoted by reference numeral 621. On the other hand, an upper limit of the light amount which can be set in the light-emitting element 203 is the smallest one of the three maximum light amount candidates denoted by reference numerals 620, 622, and 673. That is, the light amount at the position denoted by reference numeral 673 is a maximum light amount. Hence, a light amount range which can be set in the light-emitting element 203 is that denoted by reference numeral 617. In this embodiment, a middle light amount between the minimum and maximum light amounts is set as the light amount of the light-emitting element 203. However, an arbitrary light amount can be set as long as it falls within a range between the minimum and maximum light amounts.

Figure 13:
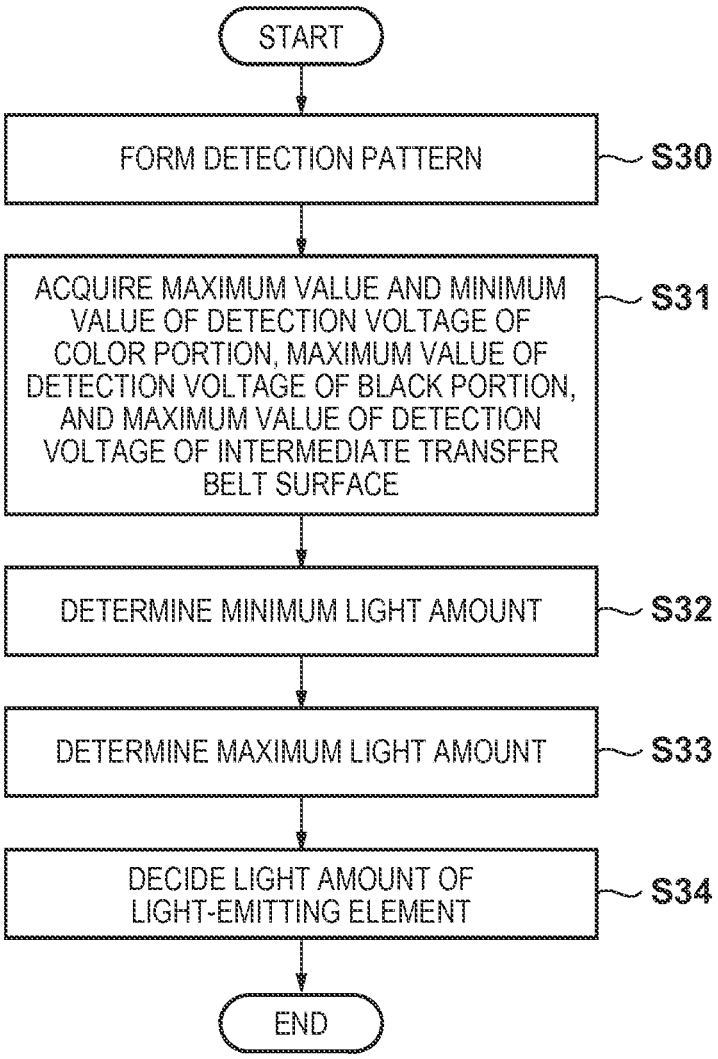
FIG. 13 is a flowchart of light amount decision control of a light-emitting element according to one embodiment.

FIG. 13 is a flowchart of light amount setting processing of the light-emitting element 203 executed by the engine control unit 302 in the third embodiment. When the misregistration/density detection control is started, the CPU 311 controls the image forming unit to form respective detection patterns in step S30. In step S31, the CPU 311 acquires minimum and maximum values of a detection voltage of a color portion and a maximum value of a detection voltage of a black portion, which are detected by the light-receiving element 204. Furthermore, the CPU 311 acquires a maximum value of a detection voltage of the surface of the intermediate transfer belt 80 detected by the light-receiving element 205. In step S32, the CPU 311 determines a minimum light amount based on the minimum value of the detection voltage of the color portion. In step S33, the CPU 311 determines a maximum light amount based on the maximum value of the detection voltage of the color portion, that of the detection voltage of the black portion, and that of the detection voltage of the intermediate transfer belt 80, as described above. Finally, the CPU 311 decides a light amount between the minimum and maximum light amounts as that to be set in the light-emitting element 203 in step S34.

With the aforementioned arrangement, the light-emitting amount of the light-emitting element 203 required to successively execute misregistration detection and density detection can be decided and set.

Note that in the respective embodiments, maximum and minimum values of detection voltages detected by the light-receiving elements 204 and 205 are obtained in consideration of variations of specular reflection light and diffuse reflection light. However, the present invention is not limited to this. That is, an arrangement which uses a single measurement value may be adopted. Alternatively, an arrangement which uses an average value or the like in place of maximum and minimum values of a plurality of times of measurement may be adopted.

Fourth Embodiment

In the first to third embodiments, the light amount of the light-emitting element 203 is set based on the received light amount of the light-receiving element 204 or 205. This embodiment will explain a method of making misregistration detection and density detection a success at the same time by changing a light-receiving sensitivity of the light-receiving element 204. Note that differences from the first embodiment will be mainly explained below, and a description of the same parts as in the first embodiment (for example, the arrangement of the image forming apparatus) will not be repeated.

Figure 14:
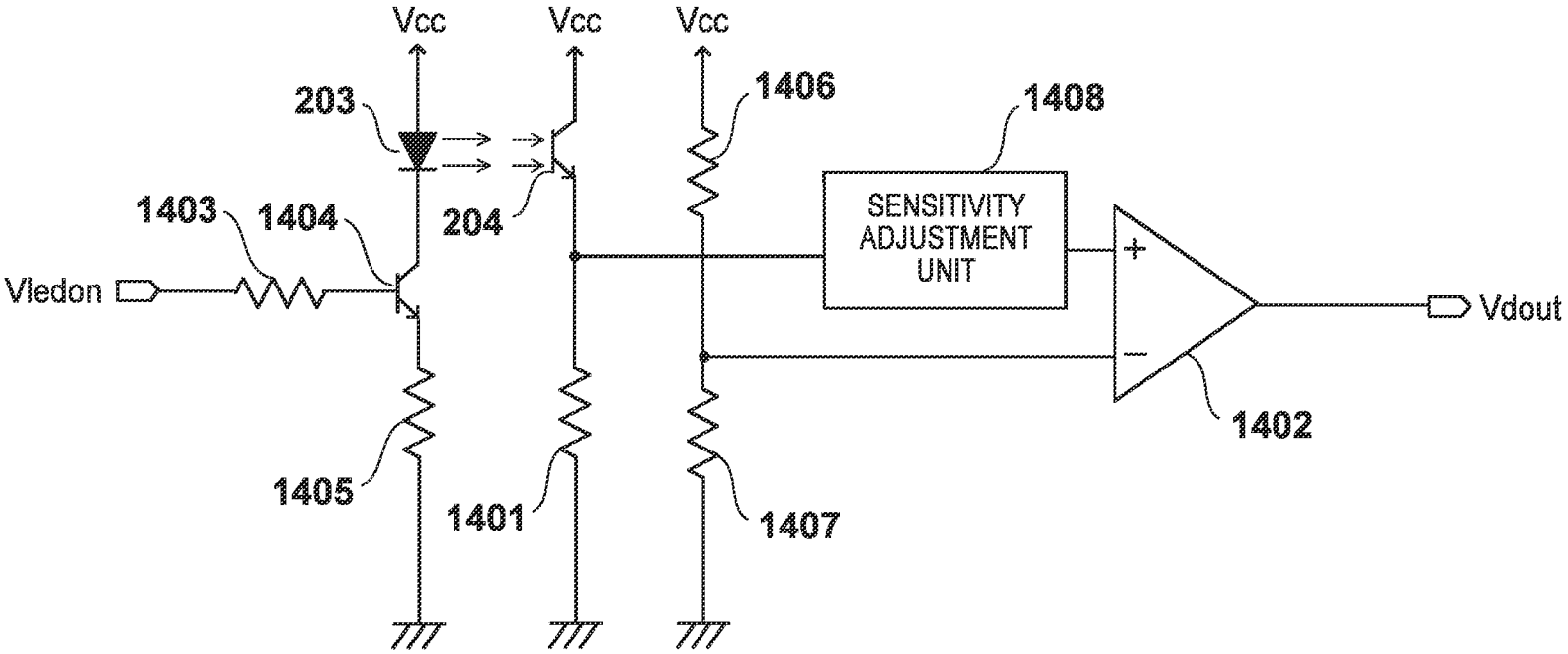
FIG. 14 is a circuit diagram showing the arrangement of a sensor unit including a light-receiving element according to one embodiment.

FIG. 14 shows an arrangement for changing the light-receiving sensitivity of the light-receiving element 204 of the sensor unit 60. A driving signal Vledon from the CPU 311 drives a switching element 1404 such as a transistor via a base resistor 1403, and a current-limiting resistor 1405 controls a current flowing through the light-emitting element 203, thus attaining emission control. Diffuse reflection light from the intermediate transfer belt 80 and detection patterns is detected by the light-receiving element 204, and a photocurrent according to the detected reflection light amount flows through a resistor 1401, thereby detecting the reflection light amount as an analog signal. A reference voltage as a desired threshold voltage set by voltage-dividing resistors 1406 and 1407 is compared with the detected analog signal using a comparator 1402 or the like, thereby converting the analog signal into a digital signal Vdout. The digital signal Vdout is input to, for example, the CPU 311, which detects a boundary of each color of the detection pattern 206 based on a change in Vdout. That is, the threshold voltage corresponds to, for example, the threshold required to detect the misregistration detection pattern 206 shown in FIG. 6. A sensitivity adjustment unit 1408 voltage-divides the analog signal input to the comparator 1402 using a transistor or the like, thereby adjusting its voltage level. That is, the sensitivity adjustment unit 1408 changes the light-receiving sensitivity (gain) of the light-receiving element 204.

Figure 15:
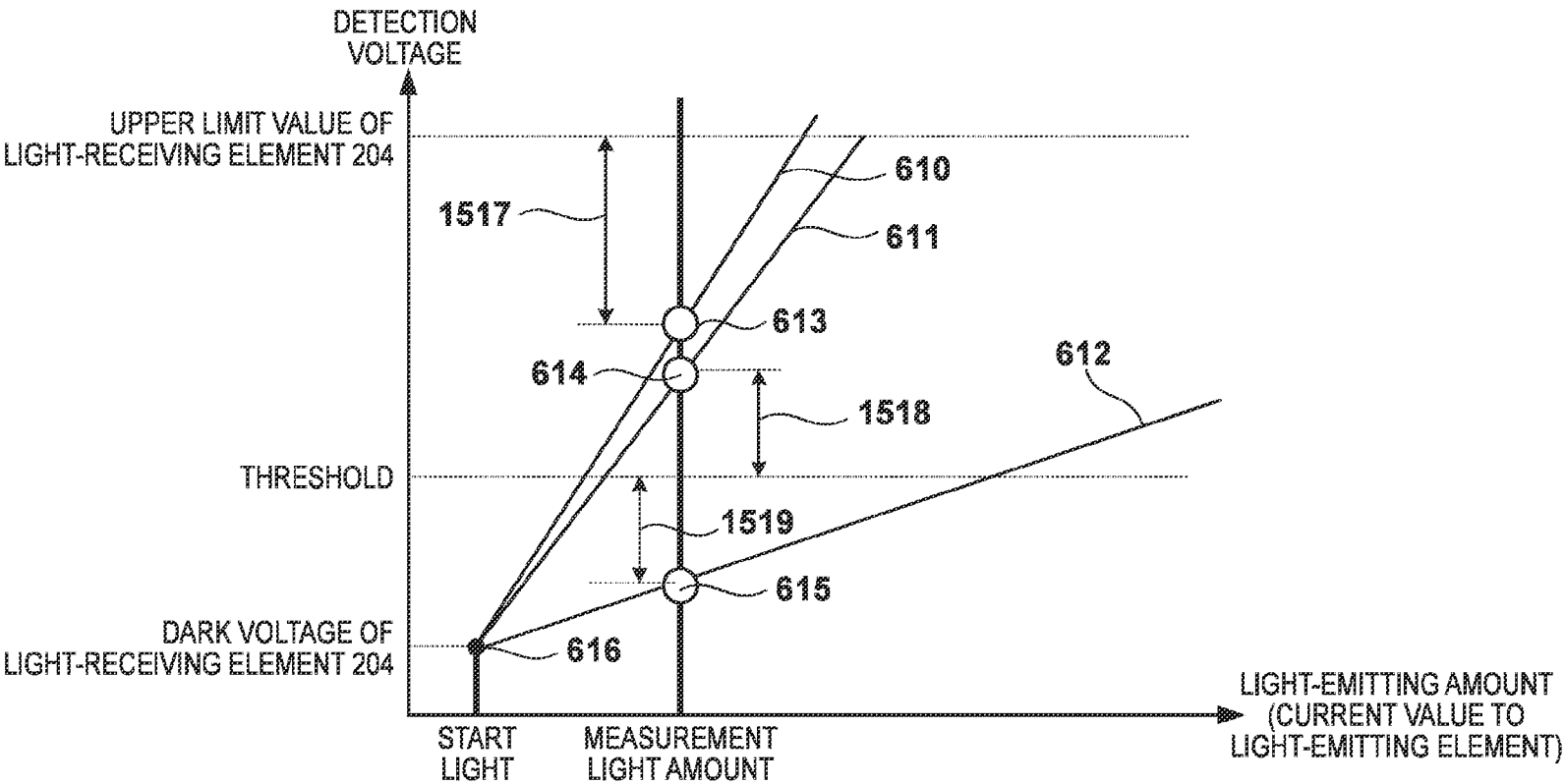
FIG. 15 is an explanatory graph of decision of sensitivities according to one embodiment.

In FIG. 15, difference values 1517 to 1519 from respective detection voltages are added to the graph shown in FIG. 6. Note that the difference value 1517 is obtained by subtracting the maximum value 613 of the detection voltage of the color portion from the upper limit value of a light amount that can be received by the light-receiving element 204. Also, the difference value 1518 is obtained by subtracting a threshold from the minimum value 614 of the detection voltage of the color portion. Furthermore, the difference value 1519 is obtained by subtracting the maximum value 615 of the detection voltage of the black portion from the threshold. Note that a description of the contents described using FIG. 6 will not be repeated.

Letting G be a sensitivity of the sensitivity adjustment unit 1408 at the time of measurement of the respective values shown in FIG. 15 and X be a difference between a start light amount and measurement light amount, we have:

$$\text{Maximum voltage 613}-\text{dark voltage of light-receiving element 204}=G\cdot\alpha1\cdot X \quad (9)$$

$$\text{Minimum voltage 614}-\text{dark voltage of light-receiving element 204}=G\cdot\alpha2\cdot X \quad (10)$$

$$\text{Maximum voltage 615}-\text{dark voltage of light-receiving element 204}=G\cdot\alpha3\cdot X \quad (11)$$

where $\alpha1$ and $\alpha2$ are coefficients which are decided by a reflectance of diffuse reflection light from the color portion and its variation, and $\alpha3$ is a coefficient which is decided by a reflectance of diffuse reflection light from the black portion and its variation.

From equations (9) to (11), all of the difference values 1517, 1518, and 1519 are expressed as functions of the sensitivity G of the sensitivity adjustment unit 1408. In this embodiment, for example, by setting the sensitivity G to minimize a variance of the difference values 1517, 1518, and 1519, margins associated with misregistration detection and density detection are optimized. However, an arbitrary sensitivity G at which the maximum value 613 does not exceed the upper limit value, the minimum value 614 is larger than the threshold, and the maximum value 615 does not exceed the threshold can be used. That is, the sensitivity G at which all of the difference values 1517, 1518, and 1519 are not less than 0 can be used. Note that letting D1, D2, and D3 respectively be the difference values 1517, 1518, and 1519, and A be an average value of D1 to D3, the variance is given by:

$$((D1-A)^2+(D2-A)^2+(D3-A)^2)/3$$

Figure 16:
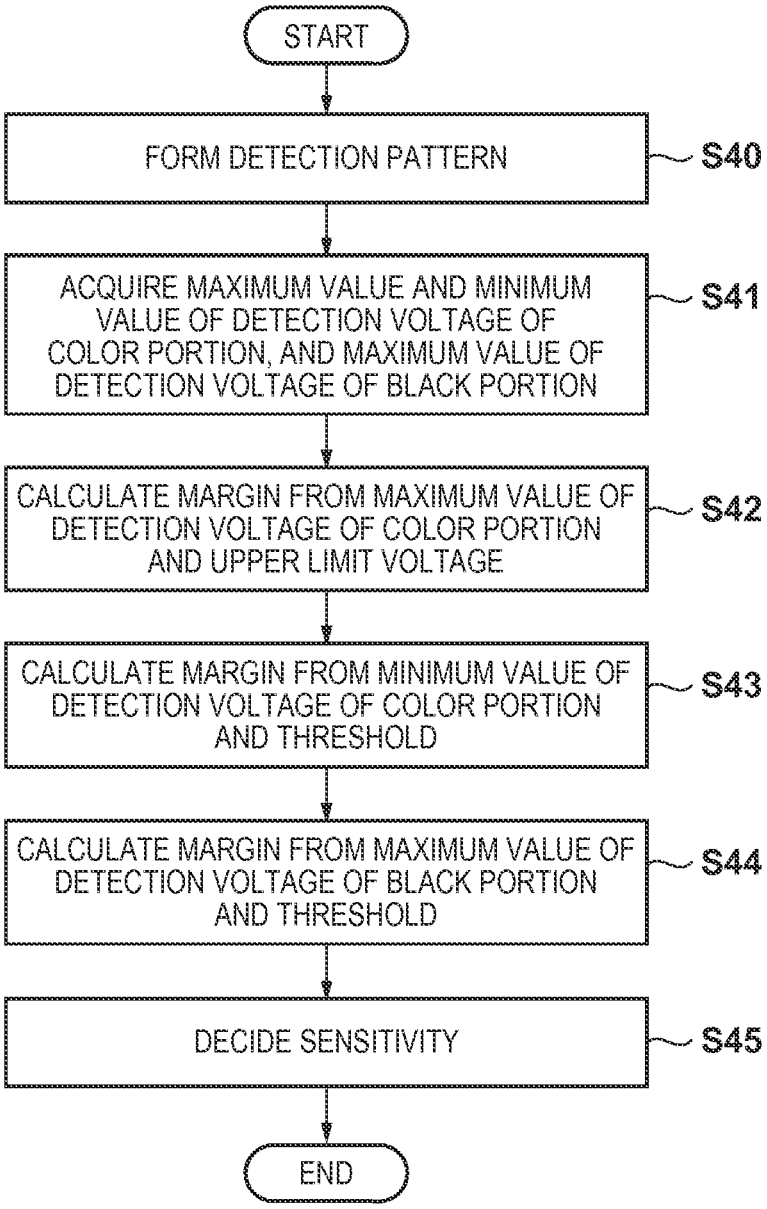
FIG. 16 is a flowchart of sensitivity decision control of a sensor unit according to one embodiment.

FIG. 16 is a flowchart of sensitivity setting processing of the light-receiving element 204 executed by the engine control unit 302 in the fourth embodiment. When the misregistration/density detection control is started, the CPU 311 controls the image forming unit to form respective detection patterns in step S40. In step S41, the CPU 311 acquires minimum and maximum values of a detection voltage of the color portion and a maximum value of a detection voltage of the black portion, which are detected by the light-receiving element 204. In step S42, the CPU 311 calculates a density detection margin corresponding to the difference 1517 in FIG. 15 by subtracting the maximum value of the detection voltage of the color portion from the upper limit voltage of the light-receiving element 204. In step S43, the CPU 311 calculates a misregistration detection margin corresponding to the difference 1518 in FIG. 15 by subtracting the threshold from the minimum value of the detection voltage of the color portion. In step S44, the CPU 311 calculates a misregistration detection margin corresponding to the difference 1519 in FIG. 15 by subtracting the maximum value of the detection voltage of the black portion from the threshold. Finally, the CPU 311 calculates, for example, a sensitivity which minimizes the variance of the three margins in step S45. Note that an arbitrary margin at which the respective margins are not less than 0 can be set.

With the aforementioned arrangement, the sensitivity of the light-receiving element 204 required to successively execute misregistration detection and density detection can be decided and set. Note that when the light-receiving element 205 of specular reflection light is used in place of the light-receiving element 204 of diffuse reflection light, the sensitivity of the light-receiving element 205 is similarly adjusted to successively execute misregistration detection and density detection. That is, the sensitivity of the light-receiving element 205 can be controlled in place of the light-emitting amount control in the second embodiment.

Fifth Embodiment

In the fourth embodiment, the light-receiving sensitivity of the light-receiving element is changed. This embodiment also changes a threshold in addition to the light-receiving sensitivity of the light-receiving element, thus making misregistration detection and density detection a success at the same time. Note that differences from the fourth embodiment will be mainly explained below, and a description of the same parts as in the fourth embodiment (for example, the arrangement of the image forming apparatus) will not be repeated.

Figure 17:
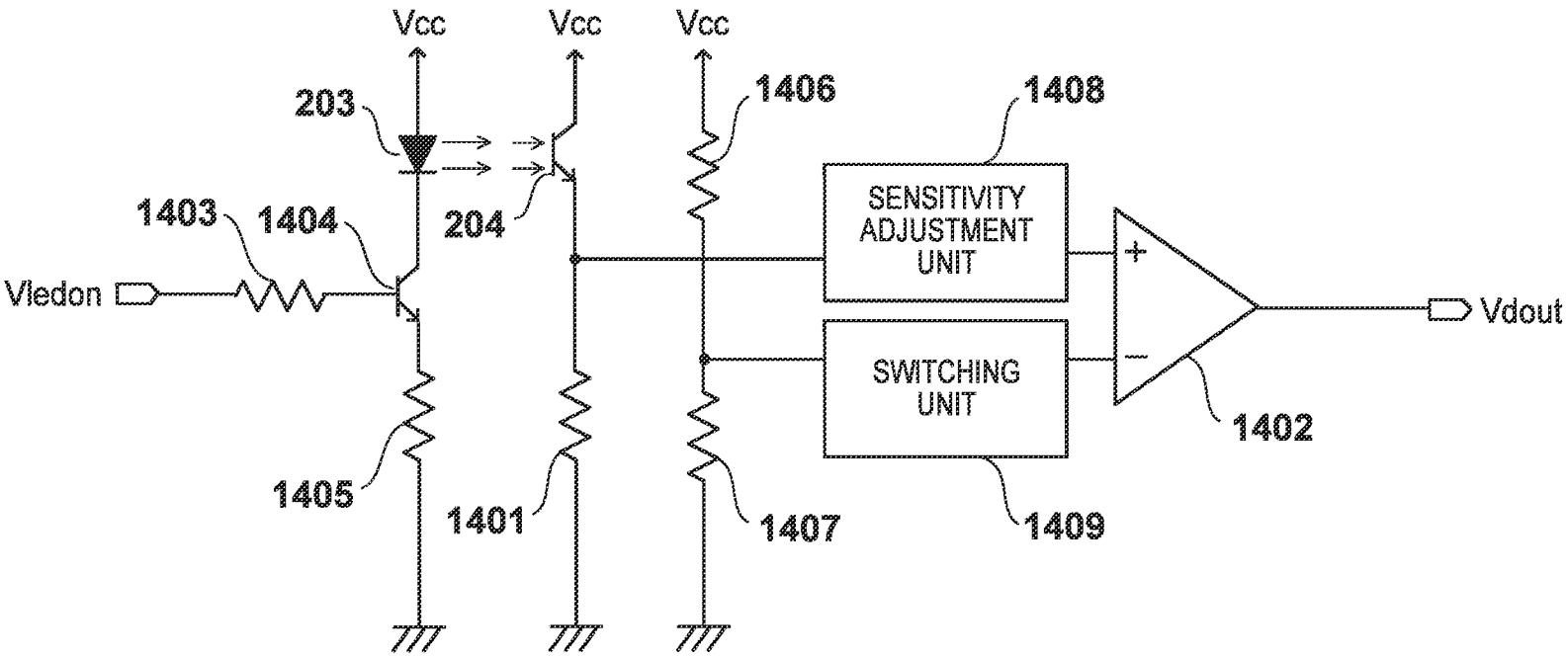
FIG. 17 is a circuit diagram showing the arrangement of a sensor unit including a light-receiving element according to one embodiment.

In FIG. 17, a switching unit 1409 used to change a threshold required to detect the misregistration detection pattern 206 is added to the detection unit shown in FIG. 14. The switching unit 1409 changes the threshold by voltage-dividing a reference voltage input to the comparator 1402 using a transistor or the like.

Figure 18:
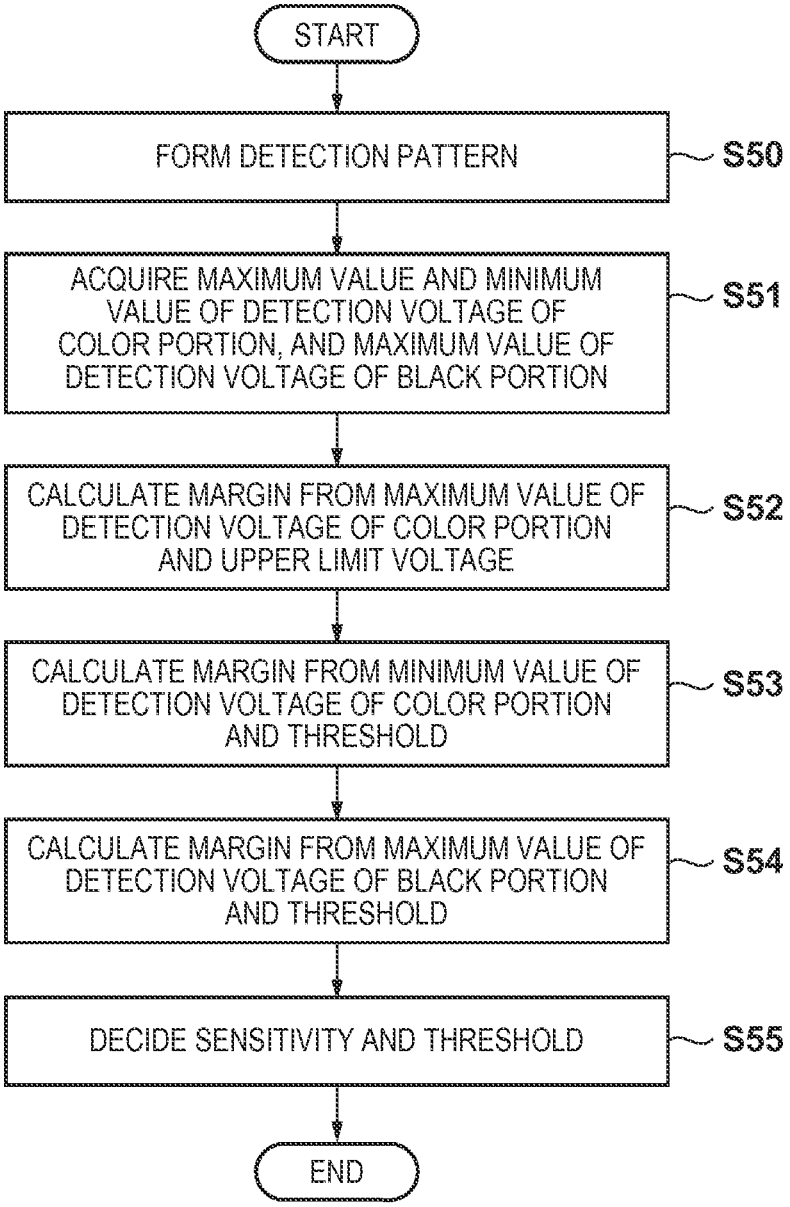
FIG. 18 is a flowchart of threshold/sensitivity decision control of a sensor unit according to one embodiment.

FIG. 18 is a flowchart of threshold/light-receiving element sensitivity setting control executed by the engine control unit 302 in this embodiment. Note that since steps S50 to S54 are the same as steps S40 to S44 in FIG. 16, a description thereof will not be repeated. In step S55, the CPU 311 changes the sensitivity of the light-receiving element 204 and threshold so that the three detection margins calculated in steps S52 to S54 are equal to each other. However, the maximum value 613 need only be less than the upper limit of the light-receiving element 204, and the threshold need only fall within a range between the minimum value 614 and maximum value 615. Hence, the threshold and sensitivity are set within that range.

For example, when the maximum value 613 is less than the upper limit of the light-receiving element 204, the threshold need only be adjusted to fall within a range between the minimum value 614 and maximum value 615. Also, for example, when the maximum value 613 exceeds the upper limit value of the light-receiving element 204, or when it does not exceed the upper limit value but a margin is small, a sensitivity which can assure a sufficient margin is decided. After that, the CPU 311 calculates changes of the maximum value 615 and minimum value 614 at the decided sensitivity, and can decide a threshold falling within a range between the calculated maximum value 615 and minimum value 614. Note that in this case, for example, the light amount of the light-emitting element 203 is set to be constant.

With the aforementioned arrangement, the light-receiving sensitivity of the light-receiving element 204 required to successively execute misregistration detection and density detection, and the threshold required to detect the misregistration detection pattern 206 can be set.

Note that in the above embodiment, the sensitivity of the light-receiving element 204 of diffuse reflection light and the threshold are controlled. However, the present invention is not limited to this. That is, an arrangement which uses specular reflection light as in the second embodiment may be adopted. Furthermore, the sensitivity of the light-receiving element 204 and threshold are to be controlled. Alternatively, the light-emitting amount of the light-emitting element 203 and threshold can be controlled. That is, when the maximum value 613 in FIG. 6 is larger than the upper limit value, the light-emitting amount may be controlled, and the threshold may be changed in association with the minimum value 614 and maximum value 615. More specifically, the light-emitting amount of the light-emitting element 203 and/or the sensitivity of the light-receiving element are adjusted so that the maximum value 913 in FIGS. 6 and 10 is less than the upper limit value of the light-receiving element. Then, the minimum value 614 and maximum value 615 in FIG. 6 or the minimum value 914 and maximum value 915 in FIG. 10 at the decided light-emitting amount and sensitivity are calculated. Then, the light-emitting amount, sensitivity, and/or threshold may be adjusted so that the threshold falls within a range between the calculated minimum value 614 and maximum value 615 in FIG. 6 or between the minimum value 914 and maximum value 915 in FIG. 10.

Other Embodiments

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (for example, computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-109929, filed on May 11, 2012, which is hereby incorporated by reference herein in its entirety.

What is claimed is:

1. An image forming apparatus comprising:

an image forming unit configured to form toner images of respective colors on an image carrier;

a detection unit configured to irradiate a surface of the image carrier or the toner images formed on the image carrier with light, and to receive reflection light; and a control unit configured to control to detect a relative misregistration amount of the toner images of the respective colors formed on the image carrier by determining, using a threshold, a received light amount of the detection unit when the detection unit detects a first detection pattern as a toner image formed on the image carrier, and to detect densities of the toner images of the respective colors formed on the image carrier by detecting, by the detection unit, a second detection pattern as a toner image formed on the image carrier, wherein the first detection pattern includes a black portion and a color portion, the control unit is further configured to form, in a case the misregistration amount and the densities are to be successively detected, both the first detection pattern and the second detection pattern on the image carrier, and after forming both the first detection pattern and the second detection pattern, to set a light-emitting amount of the detection unit or a sensitivity of the detection unit used for detecting both the first detection pattern and the second detection pattern so that a received light amount of diffuse reflection light from the black portion received by the detection unit is less than the threshold and a received light amount of diffuse reflection light from the color portion received by the detection unit exceeds the threshold, and to set the light-emitting amount of the detection unit or the sensitivity of the detection unit used for detecting both the first detection pattern and the second detection pattern so that the received light amount of the diffuse reflection light from the color portion is less than an upper limit value of the received light amount of the diffuse reflection light configured to be received by the detection unit, and the light-emitting amount of the detection unit, the threshold or the sensitivity of the detection unit is set based on a detection result of the first detection pattern.

2. The apparatus according to claim 1, wherein the control unit is further configured to calculate a first light-emitting amount from a light emitting amount of the detection unit, a received light amount of diffuse reflection light from the color portion received by the detection unit at the light-emitting amount, and the upper limit value of the received light amount of the diffuse reflection light, and to set the light-emitting amount of the detection unit to fall within a range smaller than the first light-emitting amount.

3. The apparatus according to claim 2, wherein the control unit is further configured to calculate the first light-emitting amount using a reference value which indicates a relationship between the light-emitting amount of the detection unit and a received light amount received by the detection unit.

4. The apparatus according to claim 2, wherein the control unit is further configured to calculate a second light-emitting amount from a light-emitting amount of the detection unit, a received light amount of diffuse reflection light from the color portion received by the detection unit at the light-emitting amount, and the threshold, to calculate a third light-emitting amount from the light-emitting amount of the detection unit, a received light amount of diffuse reflection light from the black portion received by the detection unit at the light-emitting amount, and the threshold, and to set a light-emitting amount of the detection unit to fall within a range which is larger than the second light-emitting amount and is smaller than a smaller one of the first light-emitting amount and the third light-emitting amount.

5. The apparatus according to claim 4, wherein the control unit is further configured to calculate the second light-emitting amount and the third light-emitting amount using a reference value which indicates a relationship between the light-emitting amount of the detection unit and a received light amount received by the detection unit.

6. The apparatus according to claim 2, wherein the control unit is further configured to set, as the threshold, a value between a received light amount of diffuse reflection light from the color portion and a received light amount of diffuse reflection light from the black portion received by the detection unit at the light-emitting amount of the detection unit, which is set to fall within the range smaller than the first light-emitting amount.

7. The apparatus according to claim 1, wherein the control unit is further configured to set a sensitivity of the detection unit so that a received light amount of diffuse reflection light from the color portion received by the detection unit at a light-emitting amount set in the detection unit is less than the upper limit value of the received light amount of the diffuse reflection light.

8. The apparatus according to claim 7, wherein the control unit is further configured to set the sensitivity of the detection unit so that a received light amount of diffuse reflection light from the color portion received by the detection unit at a light-emitting amount set in the detection unit is larger than the threshold, and a received light amount of diffuse reflection light from the black portion received by the detection unit at the light-emitting amount set in the detection unit is less than the threshold.

9. The apparatus according to claim 8, wherein the control unit is further configured to set the sensitivity of the detection unit, at a light-emitting amount set in the detection unit, by calculating a variance of a difference between a received light amount of diffuse reflection light from the color portion and the upper limit value of the received light amount of the diffuse reflection light, a difference between the received light amount of the diffuse reflection light from the color portion and the threshold, and a difference between a received light amount of diffuse reflection light from the black portion and the threshold.

10. The apparatus according to claim 1, wherein the control unit is further configured to form, when the misregistration amount and the densities are to be successively detected, both the first detection pattern and the second detection pattern on the image carrier, and to further set a light-emitting amount or a sensitivity of the detection unit so that a received light amount of specular reflection light from a surface of the image carrier received by the detection unit is less than an upper limit value of a received light amount of specular reflection light configured to be detected by the detection unit.

11. The apparatus according to claim 7, wherein the control unit is further configured to set a value between a received light amount of diffuse reflection light from the color portion and a received light amount of diffuse reflection light from the black portion as the threshold at a light-emitting amount set in the detection unit and a sensitivity of the detection unit which is set so that the received light amount of the diffuse reflection light from the color portion received by the detection unit is less than the upper limit value.

12. The apparatus according to claim 1, wherein the first detection pattern and the second detection pattern are unfixed images formed on the image carrier.

13. The apparatus according to claim 1, wherein the image carrier is an intermediate transfer belt.

14. The apparatus according to claim 1, wherein the detection unit includes:

a light-emitting element;

a first light-receiving element configured to receive specular reflection light from the surface of the image carrier or a toner image formed on the image carrier; and a second light-receiving element configured to receive diffuse reflection light from the surface of the image carrier or a toner image formed on the image carrier.

15. An image forming apparatus comprising:

an image forming unit configured to form toner images of respective colors on an image carrier;

a detection unit configured to irradiate a surface of the image carrier or the toner images formed on the image carrier with light, and to detect reflection light; and a control unit configured to control to detect a relative misregistration amount of the toner images of the respective colors formed on the image carrier by determining, using a threshold, a received light amount of the detection unit when the detection unit detects a first detection pattern as a toner image formed on the image carrier, and to detect densities of the toner images of the respective colors formed on the image carrier by detecting, by the detection unit, a second detection pattern as a toner image formed on the image carrier, wherein the control unit is further configured to form, in a case the misregistration amount and the densities are to be successively detected, both the first detection pattern and the second detection pattern on the image carrier, and after forming both the first detection pattern and the second detection pattern, to set a light-emitting amount of the detection unit or a sensitivity of the detection unit used for detecting both the first detection pattern and the second detection pattern so that a received light amount of specular reflection light from the first detection pattern received by the detection unit is less than the threshold and a received light amount of specular reflection light from a surface of the image carrier received by the detection unit exceeds the threshold, and to set the light-emitting amount of the detection unit or the sensitivity of the detection unit used for detecting both the first detection pattern and the second detection pattern so that the received light amount of the specular reflection light from the surface of the image carrier is less than an upper limit value of the received light amount of the specular reflection light configured to be received by the detection unit, and the light-emitting amount of the detection unit, the threshold or the sensitivity of the detection unit is set based on a detection result of the first detection pattern.

16. The apparatus according to claim 15, wherein the control unit is further configured to calculate a first light-emitting amount from a light emitting amount of the detection unit, a received light amount of specular reflection light from the surface of the image carrier received by the detection unit at the light-emitting amount, and the upper limit value of the received light amount of the specular reflection light, and to set the light-emitting amount of the detection unit to fall within a range smaller than the first light-emitting amount.

17. The apparatus according to claim 16, wherein the control unit is further configured to calculate the first light-emitting amount using a reference value which indicates a relationship between the light-emitting amount of the detection unit and a received light amount received by the detection unit.

18. The apparatus according to claim 17, wherein the control unit is further configured to set, as the threshold, a value between a received light amount of specular reflection light from the surface of the image carrier and a received light amount of specular reflection light from the first detection pattern received by the detection unit at the light-emitting amount of the detection unit, which is set to fall within the range smaller than the first light-emitting amount.

19. The apparatus according to claim 16, wherein the control unit is configured to calculate a second light-emitting amount from a light-emitting amount of the detection unit, a received light amount of specular reflection light from the surface of the image carrier received by the detection unit at that light-emitting amount, and the threshold, to calculate a third light-emitting amount from the light-emitting amount of the detection unit, a received light amount of specular reflection light from the first detection pattern received by the detection unit at the light-emitting amount, and the threshold, and to set a light-emitting amount of the detection unit to fall within a range which is larger than the second light-emitting amount and is smaller than smaller one of the first light-emitting amount and the third light-emitting amount.

20. The apparatus according to claim 15, wherein the control unit is further configured to set a sensitivity of the detection unit so that a received light amount of specular reflection light from the surface of the image carrier received by the detection unit at a light-emitting amount set in the detection unit is less than the upper limit value of the received light amount of the specular reflection light.

21. The apparatus according to claim 20, wherein the control unit is further configured to set the sensitivity of the detection unit so that a received light amount of specular reflection light from the surface of the image carrier received by the detection unit at a light-emitting amount set in the detection unit is larger than the threshold, and a received light amount of specular reflection light from the first detection pattern received by the detection unit at the light-emitting amount set in the detection unit is less than the threshold.

22. The apparatus according to claim 21, wherein the control unit is further configured to set a value between a received light amount of specular reflection light from the surface of the image carrier and a received light amount of specular reflection light from the first detection pattern as the threshold at a light-emitting amount set in the detection unit and a sensitivity of the detection unit which is set so that the received light amount of the specular reflection light from the surface of the image carrier received by the detection unit is less than the upper limit value.

23. The apparatus according to claim 15, wherein the first detection pattern and the second detection pattern are unfixed images formed on the image carrier.

24. The apparatus according to claim 15, wherein the image carrier is an intermediate transfer belt.

25. The apparatus according to claim 15, wherein the detection unit includes:

a light-emitting element;

a first light-receiving element configured to receive specular reflection light from the surface of the image carrier or a toner image formed on the image carrier; and a second light-receiving element configured to receive diffuse reflection light from the surface of the image carrier or a toner image formed on the image carrier.

* * * * *